US006821077B2

(12) United States Patent
Neufeldt

(10) Patent No.: US 6,821,077 B2
(45) Date of Patent: Nov. 23, 2004

(54) WASTE AND RECYCLABLE MATERIALS COMPACTION AND HANDLING APPARATUS

(75) Inventor: Dennis Neufeldt, Lethbridge (CA)

(73) Assignee: Haul-All Equipment Ltd., Lethbridge (CA)

( * ) Notice: Subject to any disclaimer, the term of this patent is extended or adjusted under 35 U.S.C. 154(b) by 253 days.

(21) Appl. No.: 10/015,069

(22) Filed: Oct. 26, 2001

(65) Prior Publication Data

US 2002/0098070 A1 Jul. 25, 2002

(51) Int. Cl.[7] ..... B65F 3/02
(52) U.S. Cl. ..... 414/525.6; 100/209; 414/406
(58) Field of Search ..... 100/209, 233, 100/240, 245; 414/525.6, 408, 406, 409, 492, 525.2, 679; 220/908; 198/747

(56) References Cited

U.S. PATENT DOCUMENTS

| | | | | | |
|---|---|---|---|---|---|
| 2,002,993 | A | * | 5/1935 | Ehrick et al. | 100/209 |
| 3,844,434 | A | * | 10/1974 | Blakeley et al. | 414/409 |
| 3,983,800 | A | * | 10/1976 | Booth | 100/209 X |
| 4,070,962 | A | * | 1/1978 | Peterson | 100/209 |
| 4,996,918 | A | * | 3/1991 | Carter et al. | 100/52 |
| 5,035,564 | A | * | 7/1991 | Matsumoto | 414/409 |
| 5,307,607 | A | * | 5/1994 | Tondo | 53/438 |
| 5,402,716 | A | * | 4/1995 | Holtom | 100/233 |
| 5,458,058 | A | * | 10/1995 | Zeronian et al. | 100/233 |
| 5,772,384 | A | * | 6/1998 | Richards | 414/408 |
| 5,836,470 | A | * | 11/1998 | Neelly et al. | 220/908 |
| 6,077,020 | A | | 6/2000 | Neufeldt et al. | |
| 6,296,132 | B1 | * | 10/2001 | Pickler | 220/908 |

OTHER PUBLICATIONS

Brochure—Heil Formula® 7000 Curved Shell Automated Side Loader, 1993.
Brochure—Heil Formula® 7000 Automated Side Loader, 1993.
Brochure—Heil Rapid Rail® Automated Side Loader, 1993.
Brochure—Labrie Expert 2000 Side Loading Refuse Packer.
Brochure—Heil Colectomatic 4000 Mid–Range Rear Loader , 1987.
Brochure—Labrie Optimizer Front End Loading Body , 1999.
Brochure—Labrie Expert Front Loader.

* cited by examiner

*Primary Examiner*—James W. Keenan
(74) *Attorney, Agent, or Firm*—Dinsmore & Shohl LLP

(57) ABSTRACT

A waste and recyclables materials compaction and handling apparatus includes a storage container for the materials. An elongated charging hopper is defined adjacent to and alongside the storage container for receiving the materials, the charging hopper having open end portions defining pathways leading into the interior of the storage container. A packing head is mounted for travel within and along the charging hopper between the open end portions and at least one driver is connected to the packing head to effect the travel thereof along the charging hopper between positions adjacent the open end portions. The packing head has opposed packing faces adapted to engage the materials placed in the charging hopper. As the packing head is driven along the charging hopper, the materials are compacted and forced along the charging hopper and, depending on the direction of travel of the packing head, through one or the other of the pathways defined by the charging hopper open end portions and thence into the interior of the storage container.

23 Claims, 20 Drawing Sheets

WASTE AND RECYCLABLE MATERIALS COMPACTION AND HANDLING APPARATUS

BACKGROUND OF THE INVENTION

This invention relates to improved multifunctional waste and recyclable materials compaction and handling apparatus.

The collection of Municipal Solid Waste (MSW), as well as Institutional, Commercial and Industrial (ICI) waste has undergone a major transformation in the last 50 years. As more and more materials are separated form the waste stream and the quantities of waste generated have increased, particularly in North America, all types of specialized equipment have evolved. This, in combination with ever increasing budget constraints for municipalities, has created the opportunity to market a multifunctional collection vehicle that can handle the various collection methods as well as material types.

A typical prior art collection apparatus uses a hydraulic mechanism to compact the refuse into a storage container. Typically this container is mounted to the frame of a truck chassis and has a tailgate rotatably secured to the rear of the container. To remove the material from the container, the tailgate is rotated from a down locked position to an upper open position. The material is ejected from the container by either rotating the container from a lower loading position to an upper dumping position or by using a blade to push the material out of the opening created by the open tailgate.

In one version, the collection apparatus has the packing mechanism contained within the tailgate. The advantage of this system is that the mechanism can be made relatively large to be able to handle a wide variety of materials as well as achieve a high degree of compaction. The disadvantages of this arrangement are that more than one operator is required because of the walking distance from the cab to the hopper opening for manual collection and the requirement to move heavy containers to the compactor for emptying. Another disadvantage is that they typically have poor weight distribution because the packing mechanism, which is a large percentage of the overall weight, is located behind the rear axle.

Another typical configuration is a body that loads from the front of the chassis using arms to pick up containerized material. The container is rotated over the cab of the chassis to empty material into the loading hopper. The mechanism includes is a blade which pushes the material into the storage container. The advantage of these units is that one operator can empty containers and achieve a substantial payload. One disadvantage of this configuration is the access space required to hook onto the containers. Another disadvantage is that the substantial mechanism required to lift the containers over the cab is heavy and requires a large chassis to operate practically. A side effect of the mechanism handling the container is the damage to the containers and their lids.

Similar body configurations, with the packing mechanism mounted above the chassis frame to compact material to the rear storage container, have side mounted equipment to lift and rotate containers to empty the contents into the charging hopper. The advantage of this type of equipment is that the automated collection of containers by one operator is very efficient. The disadvantage of these units is that the initial capital costs and the specialized and dedicated applications they are designed for limits their flexibility, including the size of containers that can be collected and types of material collected. In this type of unit the compaction mechanism can be either a push blade, a "pendulum" packer which rotates down and to the rear or a "paddle" packer which moves the material to the rear storage container by sweeping from side to side in a rounded hopper.

A slightly different configuration, which also uses a packing blade to push material from the front charging hopper to the rear storage container, uses a drop frame to lower the packing mechanism to allow for manual collection. The advantage of this configuration is the capability for one operator to collect door to door manually, or, with the appropriate additional mechanism, semi-automated or automated carts. The disadvantage of these types of units is the requirement to modify the chassis frame. The relatively high loading height even with the drop frame, and the relatively small charging hopper limits the size of material that can be handled as well as the size of carts or containers that can be dumped.

In all of these configurations, the packing mechanism moves the material in one direction. The paddle packer, even though it moves in a rotary action from side to side, only moves the material to the into the storage container to the rear of the paddle and effectively acts like a single direction push blade. This operation in one direction is the simplest and most effective for many specialized applications but limits the versatility for multiple applications.

Except for the unit described with the packing mechanism in the tailgate, all of the other units require a chassis with a substantial wheelbase to accommodate the packing mechanism between the chassis cab and the storage container. The long wheelbase, which limits the units manoeuverability, restricts these units from certain tight areas and slows the collection process in areas where turns cannot be achieved without backing up.

Other units on the market have loading hoppers on the side which also act as the compacting mechanism. The advantage of these units is that they overcome the turning radius problems and versatility constraints of the aforementioned configurations but have limited compaction capability. The large loading/packing mechanism allows for collection of virtually any size or type material in the MSW and ICI streams, but the length of the packing mechanism and the packing motion from side to side, limits the payload for some materials.

There are several issues beyond the personnel requirements and route planning that affect the operational efficiency of a collection program. As traffic becomes more and more abundant in many municipalities, the turn around time to dispose of the waste and return to the collection route increases. Also, the distance required to travel to landfills is increasing as old landfills are filled and new landfills are located further from the urban areas. Another important issue is the separation of material for recycling. Many of the aforementioned units can collect some separated materials but have difficulty or practically cannot collect a complete range of materials. As previously mentioned, the collection operation must be done in spite of ever increasing budget constraints on parks, municipalities and regional districts.

In view of the aforementioned problems, it would be desirable if a refuse compaction and handling apparatus could be provided which would overcome the above disadvantages while retaining as many of the advantages as possible. A collection body that could be installed one a wide variety of chassis including single rear axles as well as larger tandems, would provide a cost efficient solution for a range of collection requirements. A collection body that could collect material in three different ways, i.e., manually, or using semi-automated or automated carts, as well as large containers for recycling and ICI collection, would provide the utility required by smaller operations and the efficiency required for larger operations. In addition, it would be desirable to provide a compaction apparatus that could collect bulky recyclables like old corrugated cardboard in addition to MSW and ICI waste.

In addition, it would be desirable to provide a refuse compacting apparatus that would balance the load between the front and rear axles to optimize the chassis capability and allow for the purchase of the least expensive chassis for a desired payload.

SUMMARY OF THE INVENTION

In an effort to provide a solution to the aforementioned problems, the present invention provides a refuse/recyclable materials compaction and handling apparatus which is versatile in both the types of collection that can be achieved. The types of material that can be collected, as well as the types of chassis that the storage container/compaction apparatus can be mounted on. Accordingly, the refuse/recyclables compaction and handling apparatus of the invention addresses the complex and often contradictory demands of collecting manually as well as with containerization, mixed waste as well as source separated materials and payload optimization on various chassis configurations.

Accordingly the invention provides a waste and recyclables material compaction and handling apparatus including a storage container for said materials. An elongated charging hopper is defined adjacent to and alongside said storage container for receiver the materials, said charging hopper having open end portions defining pathways leading into the interior of said storage container. A packing head is mounted for travel within and along said charging hopper between said open end portions and at least one driver is connected to said packing head to effect the travel thereof along said charging hopper between positions adjacent said open end portions. Said packing head has opposed picking faces adapted to engage the materials placed in said charging hopper. As said packing head is driven along said charging hopper, said materials are compacted and forced along the charging hopper and, depending on the direction of travel of said packing head, through one or the other of said pathways defined by said charging hopper open end portions and thence into the interior of the storage container.

In a preferred form of the invention the packing head is mounted for travel along an elongated support assembly extending lengthwise of said charging hopper. Furthermore said at least one driver preferably comprises at least one hydraulic packing cylinder extending lengthwise of said charging hopper.

In a preferred embodiment said support assembly and said at least one hydraulic cylinder extend along a side portion of said charging hopper, said charging hopper being located along a lower portion of said storage container. Preferably a pair of said hydraulic packing cylinders is provided, each being adapted for moving the packing head in a respective one of rearward and forward directions of travel.

According to a further preferred feature said storage container includes wall portions contoured to assist in movement of the materials being compressed by said packing head through said open end portions and into and within the interior of the storage container. Desirably, said wall portions comprise a frontal contoured end section and a rear contoured end section of said storage container both shaped to facilitate said movement of the materials into and within said storage container. A further preferred feature is that said rear end section is hinged to provide a tailgate which can be opened to permit the contents of the storage container to be dumped. Pivotal connections for securing the compaction and handling apparatus to the chassis of a transport vehicle are typically provided along with mechanisms for opening and closing said tailgate in the course of a dumping procedure.

A further desirable feature includes a clean out panel mounted for pivotal movement within the storage container adjacent said frontal end section, and an actuator for pivoting said clean out panel to dislodge materials adjacent said frontal end section.

In a preferred form of the invention a loading hopper is mounted adjacent to and alongside said charging hopper for movement from a first lowered position to permit ready filling of the loading hopper to a second raised position above the charging hopper for dumping of materials into the charging hopper. Preferably said loading hopper has a retractable side wall which moves to enlarge the capacity of the loading hopper during filling and which partly closes during movement to the second raised position.

In operation, as the packing head moves back and forth within the charging hopper, the material is compacted into both the front and rear of the storage container. The preferred shape of the container allows the material to flow in all directions and fill the storage container to capacity.

As noted above, a support assembly is preferably provided to house one or more hydraulic cylinders which provide the motive force to cycle the packing head from the front to the rear of the charging hopper and back. The cylinder(s) provide sufficient pressure to the packing head to force the materials into the storage container through the openings at each end of the charging hopper. The size of the openings at the ends of the charging hopper may be adjustable to accommodate different materials.

As noted above, suitable means may be provided for loading material into the charging hopper. Although loading can be done manually directly into the charging hopper, this would not be practical for most applications. Therefore, means are preferably provided to accept materials from a lower loading position and to move the materials to a higher unloading position partially or completely inverted over the charging hopper.

One preferred such means as noted above is a loading hopper that is sized for the appropriate application. The hopper rotates from a lower loading position to a higher, partially or completely inverted dumping position. In the simplest configuration, this hopper has a fixed volume with a loading height appropriate to the application. In another configuration the loading hopper maybe provided with a retractable side wall that opens to accept a large quantity of material, and which retracts in cooperation with the storage container and charging hopper as it rotates from the lower loading position to the higher, unloading position. This configuration would be compatible for dumping containers with a fixed frame and a rotatable hopper. In an additional configuration, the loading hopper may be equipped with a means to unload carts or containers for semi-automated collection. The hopper may also be modified or eliminated completely and replaced with a means to dump carts or containers for automated collection.

DETAILED DESCRIPTION OF PREFERRED EMBODIMENTS

Figure 1:
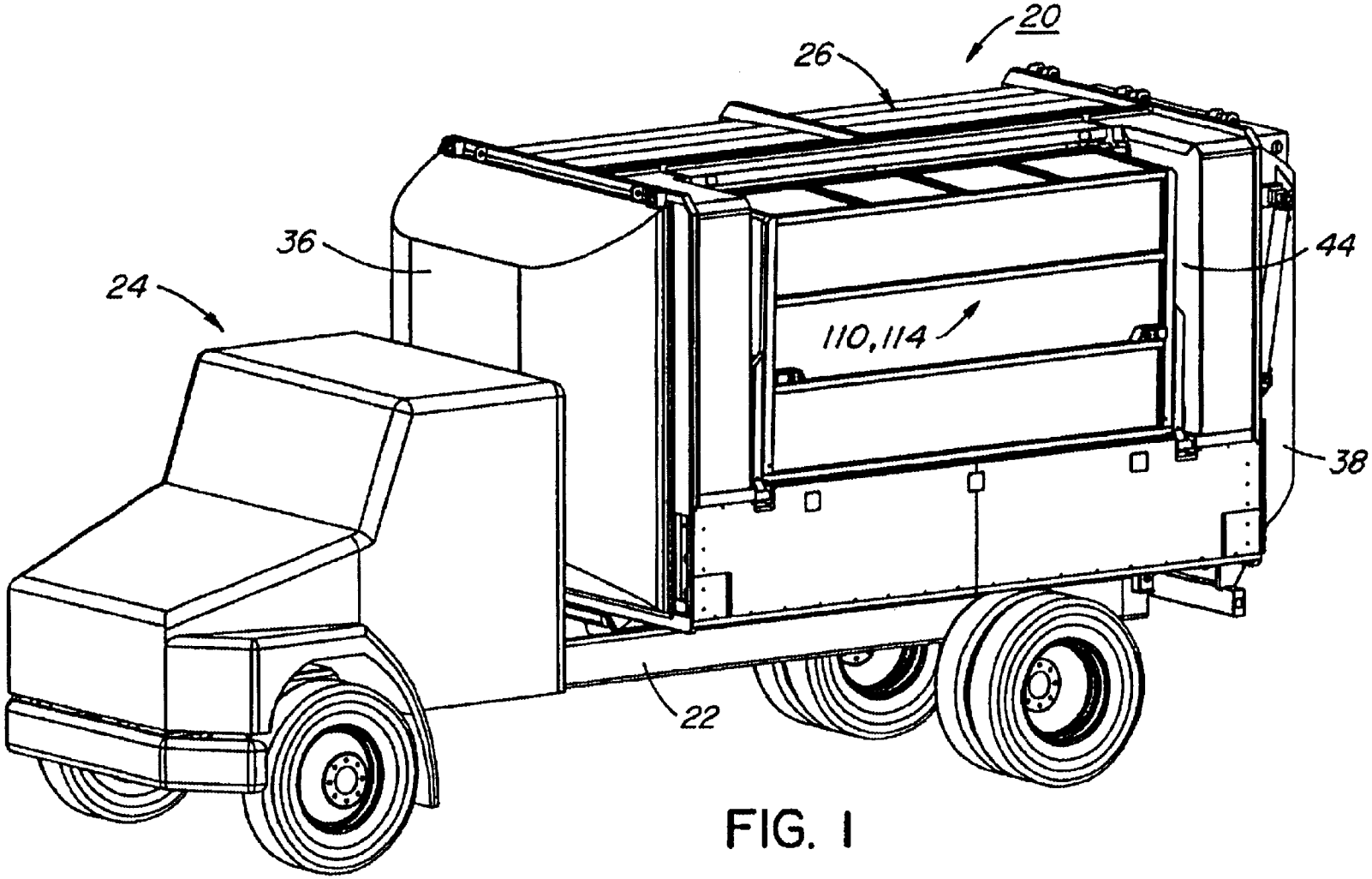
FIG. 1 is a perspective view of a waste/recyclables materials compaction and handling apparatus in accordance with a preferred embodiment of the invention when mounted on a suitable vehicle.
Figure 2:
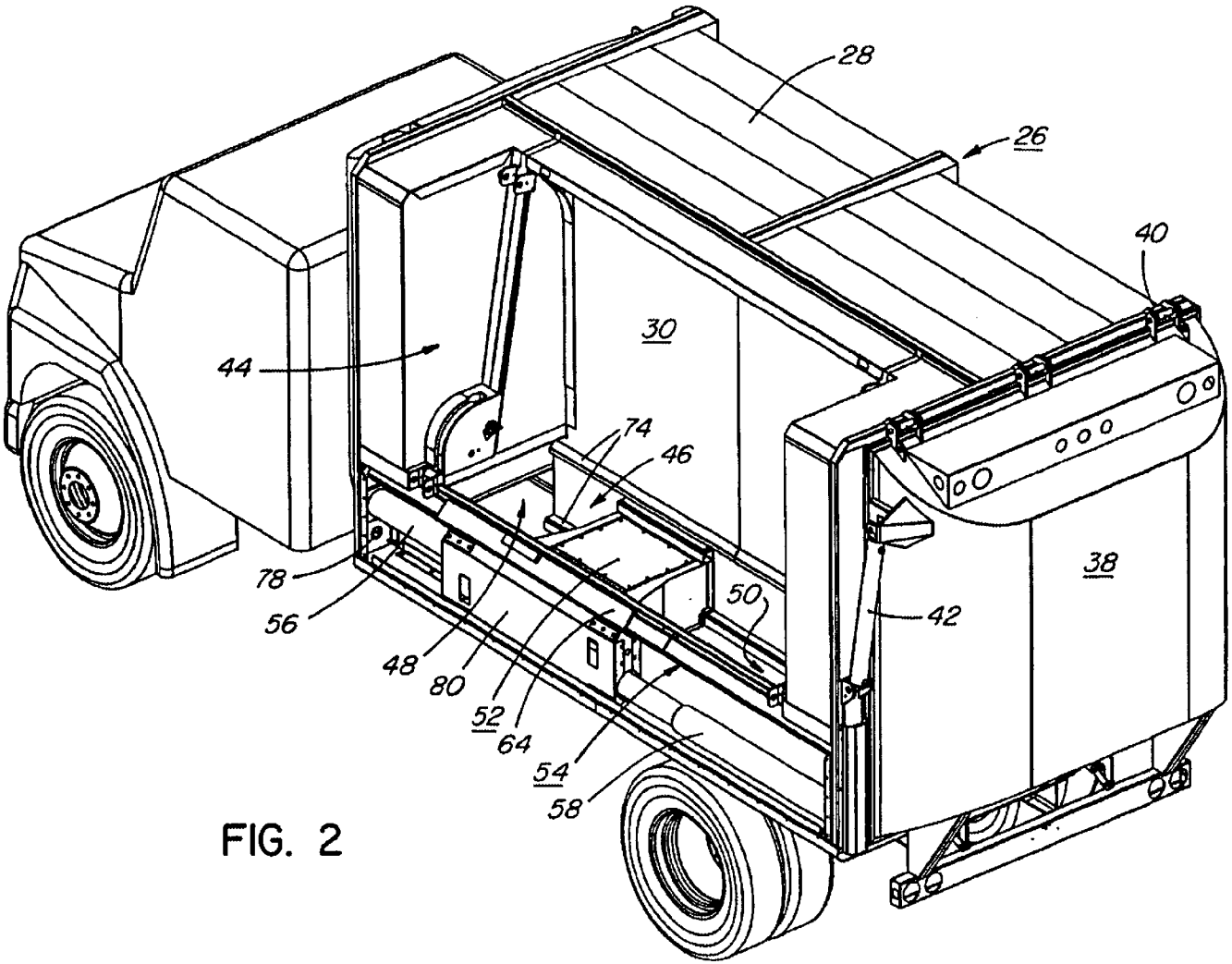
FIG. 2 is a perspective view of the compaction and handling apparatus with the loading hopper removed and looking generally downwardly into the charging hopper from the rear of the apparatus.
Figure 3:
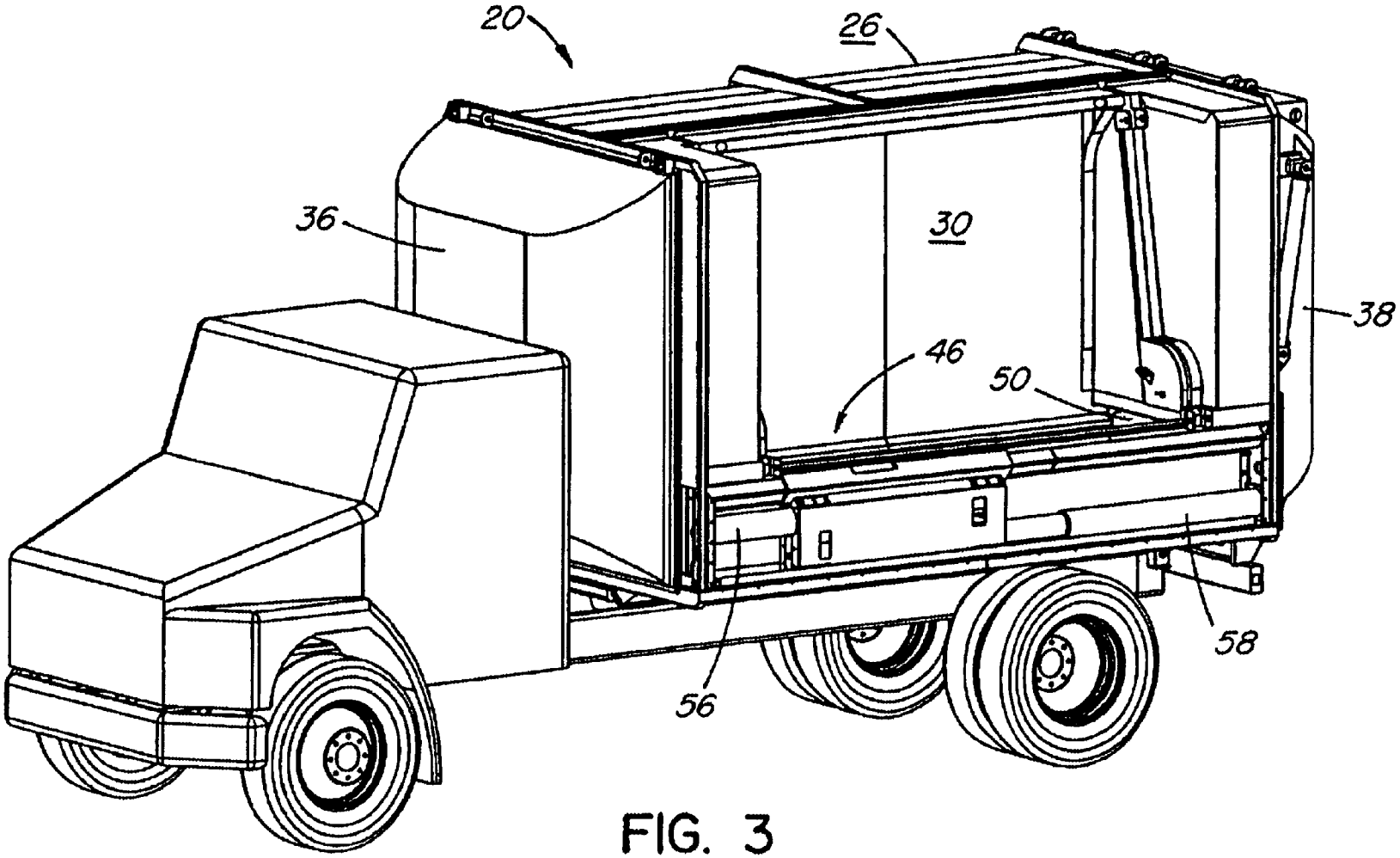
FIG. 3 is a further perspective view very similar to FIG. 1 but with the loading hopper removed so as to show the underlying assemblies.
Figure 4:
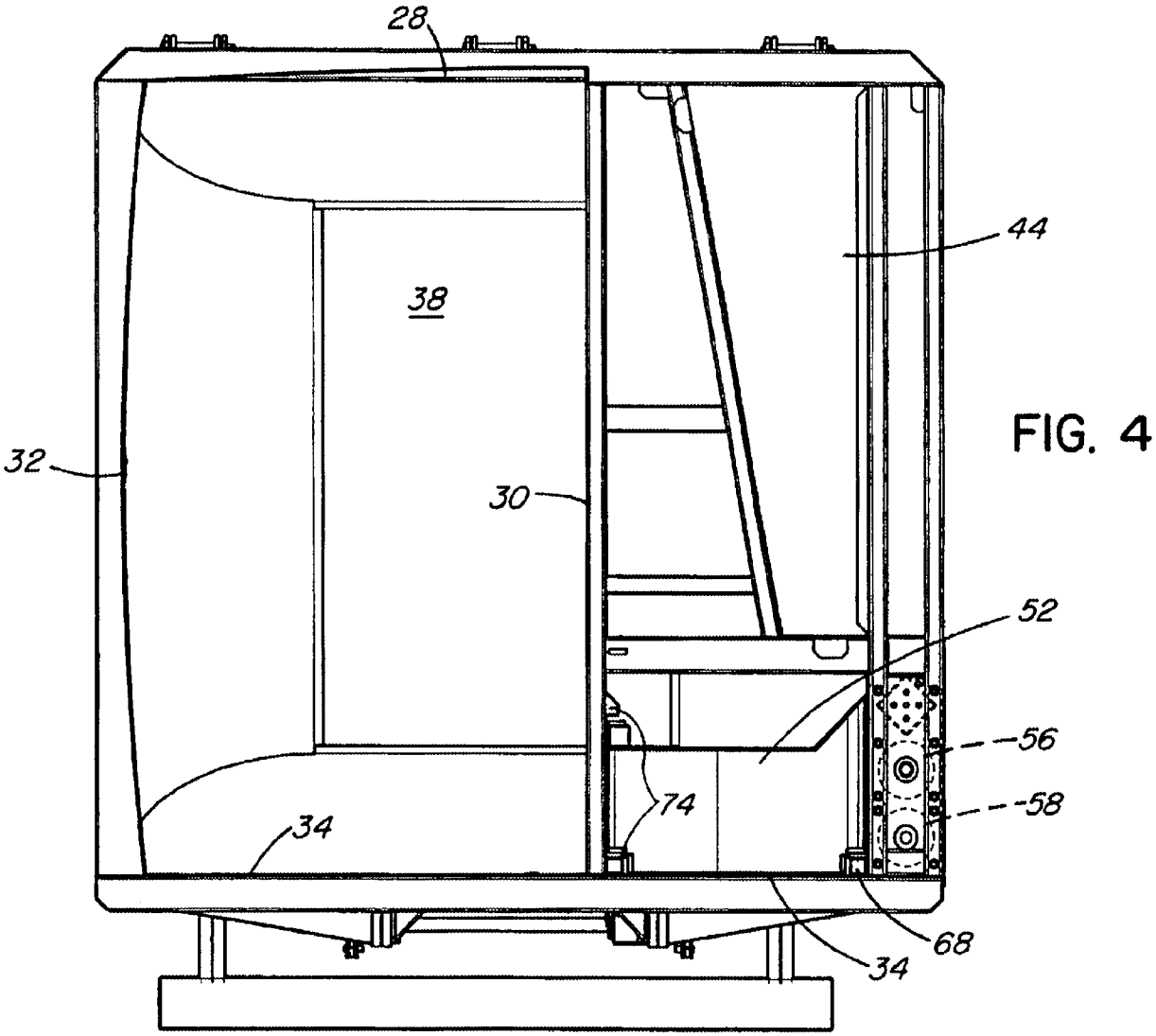
FIG. 4 is a transverse vertical section view taken through the storage container and charging hopper showing the packing head, container divider wall, and certain external panels of the storage container.
Figure 5:
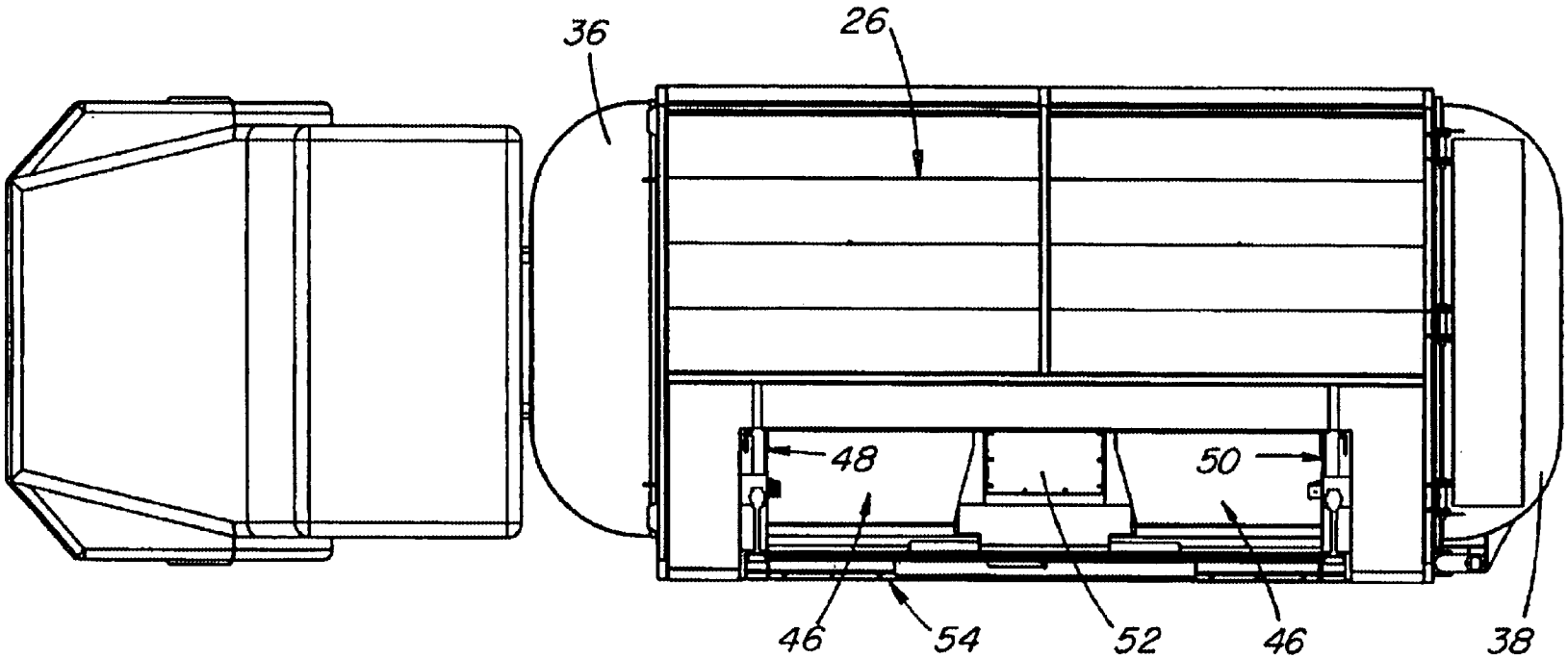
FIG. 5 is a top plan view of the truck mounted compaction and handling apparatus showing the relative positions of the storage container, charging hopper, packing head and related assemblies.

Referring now to the drawings, FIGS. 1 and 2 are perspective views of the materials compaction and handling apparatus 20 mounted on the chassis 22 or a truck 24. The apparatus 20 includes a storage container 26 including a top wall 28, a vertical divider wall panel 30, exterior wall panel 32, a floor 34 (see FIG. 4), and opposed smoothly convexly curved frontal 36 and real panels 38. The rear panel 38 defines a tailgate which is hinged along its upper edge by conventional tailgate hinges 40 and this tailgate is opened and closed by a tailgate hydraulic cylinder 42. The lower edge portion of the tailgate is provided with a tailgate lock assembly to be described hereafter.

FIG. 1 shows the compaction and handling apparatus 20 together with a side mounted loading hopper 110, 114 (to be described hereafter) in the raised travel position and disposed intermediate the frontal and rear portions of the storage container 26 in a loading hopper recess 44 located above an elongated charging hopper 46 which is easily seen in FIGS. 2 and subsequent figures.

Referring to FIGS. 2–5 (which omit the loading hopper) it will be seen that the elongated charging hopper 46 is defined adjacent to and alongside the storage container 26 and that it extends along a lower portion of the storage container 26 in close proximity to and is partly defined by the above-mentioned divider panel 30. This elongated charging hopper 46 is provided with opposed open end portions 48, 50 which define pathways leading into the interior of the storage container. The size of these pathways may be varied somewhat depending on the nature of the materials being handled. A packing head 52 is mounted for travel within and along the charging hopper 46 between the open end portions 48, 50. The packing head 52 is mounted for travel along an elongated support assembly 54 which extends lengthwise of the charging hopper 46 and which, in part, serves to define an outer wall of same. Packing head 52 is driven to and fro along the length of the charging hopper 46 by means of a pair of packing cylinders namely a forward packing cylinder 56 and a rear packing cylinder 58.

The smoothly convexly contoured tailgate 36 of the storage container 26 and the correspondingly convexly contoured tailgate 38 of the storage container both assist in facilitating movement of the materials being handled through the passageways defined by the open end portions 48, 50 of the charging hopper and in helping material flow to completely fill the storage container.

Figure 6:
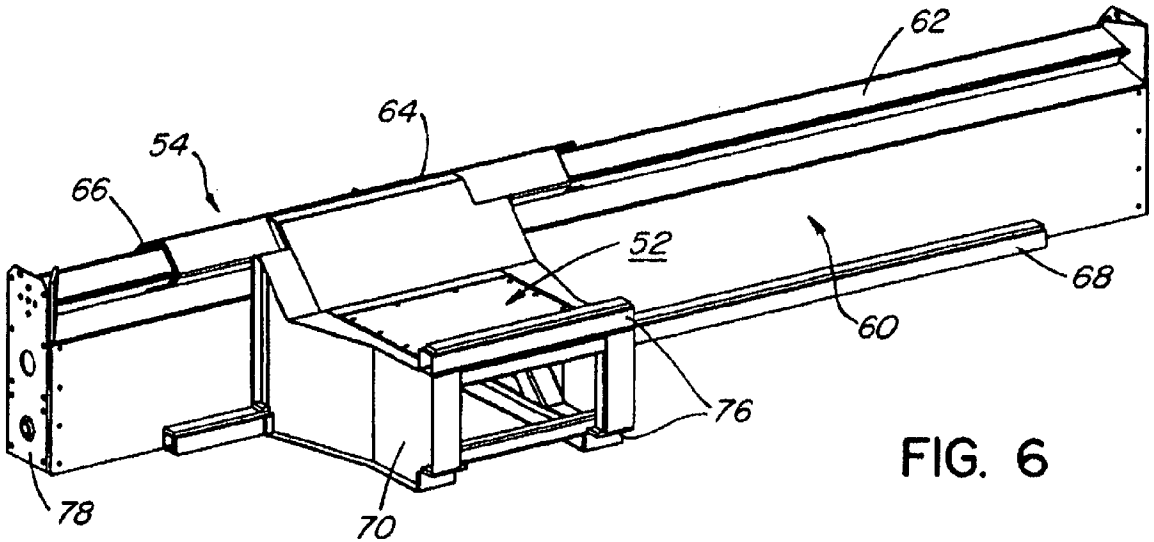
FIG. 6 is a perspective inside view of a portion of the compaction assembly showing the packing head and the packing cylinder frame assembly along which the packing head travels.
Figure 7:
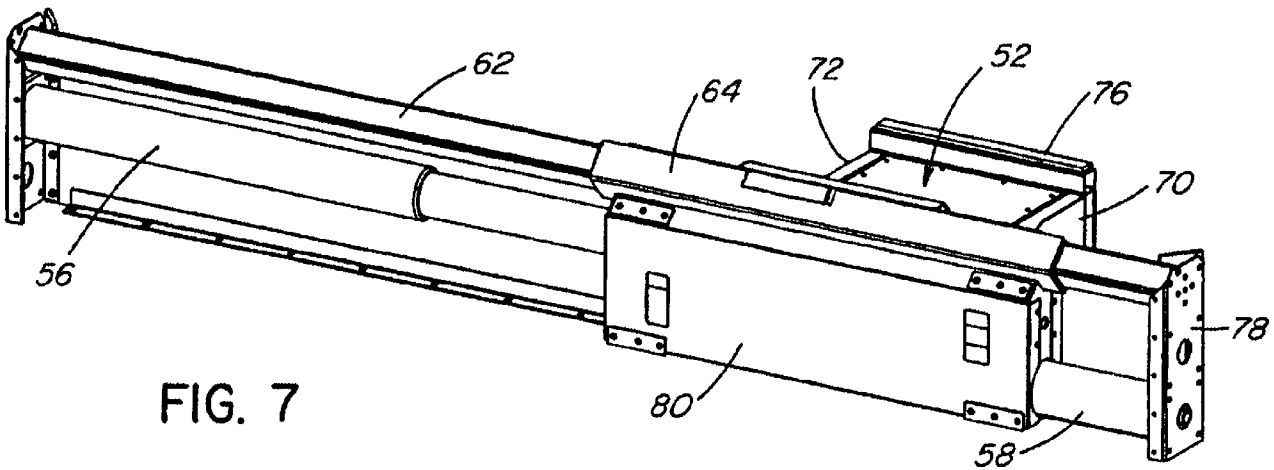
FIG. 7 is a further perspective view showing the outside of the compacting assembly including the packing cylinder frame assembly, the packing cylinders, and the packing head support arrangements.

The packing head 52 and its support and drive assemblies are best seen in FIGS. 6 and 7. The support frame assembly 54 includes an elongated packing cylinder frame 60, an upper portion of which is provided with a packing head support rail 62. The packing head 52 is provided with a slider assembly 64 which slides along the support rail 62, this slider assembly 64 being provided with suitable wear strips 66 of a material selected to reduce wear and friction. Slider assembly 64 is fixed to an outer box assembly 80 (FIG. 7) via which forces from the packing cylinders are transferred to the packing head 52 as described hereafter. The packing cylinder frame 60 is also provided with an elongated corner guide 68 extending along the lower inner surface portion of the packing cylinder frame 60 thereby to provide additional support for the packing head 52 as it is moved along the packing cylinder frame by the aforementioned packing cylinders 56, 58.

The packing head 52 itself is of a sturdy reinforced box-like structure and includes opposed packing head faces 70, 72 which engage the materials being handled as the packing head 52 travels along and within the charging hopper 46 in the course of operation.

The lower portion of the divider panel 30 is also provided with a spaced apart parallel pair of elongated packing head support strips 74 (FIG. 2) which engage mating wear elements 76 formed on the inner distal end portions of the packing head 52 thereby assuring that the packing head is securely supported during the course of its movement along and within the charging hopper 46. It will be appreciated that since relatively high compaction forces are exerted, that the packing head 52 and its associated assemblies together with the storage container 26 must all be sturdily constructed to withstand the relatively substantial compression forces involved. This also applies to the packing cylinder frame 60 previously referred to including the packing cylinder end frames 78 against which the forward and rear packing cylinders 56, 58 abut. It should be noted here that the two packing cylinders 56, 58 are located in spaced parallel relationship to one another with the forward packing cylinder 56 being disposed above the rear packing cylinder 58 with the arms of the two cylinders engaging within the outer box assembly 80 (FIG. 7) via which the forces exerted by the two cylinders are transmitted through slider assembly 64 to the packing head 52 per se. This box assembly 80 is provided with apertures in its opposing ends into which the opposing packing cylinders 56, 58 can enter as the packing head assembly (i.e., the packing head 52 and box assembly 80) is driven from one end of the packing cylinder frame to the other during the course of normal operations.

Figure 8:
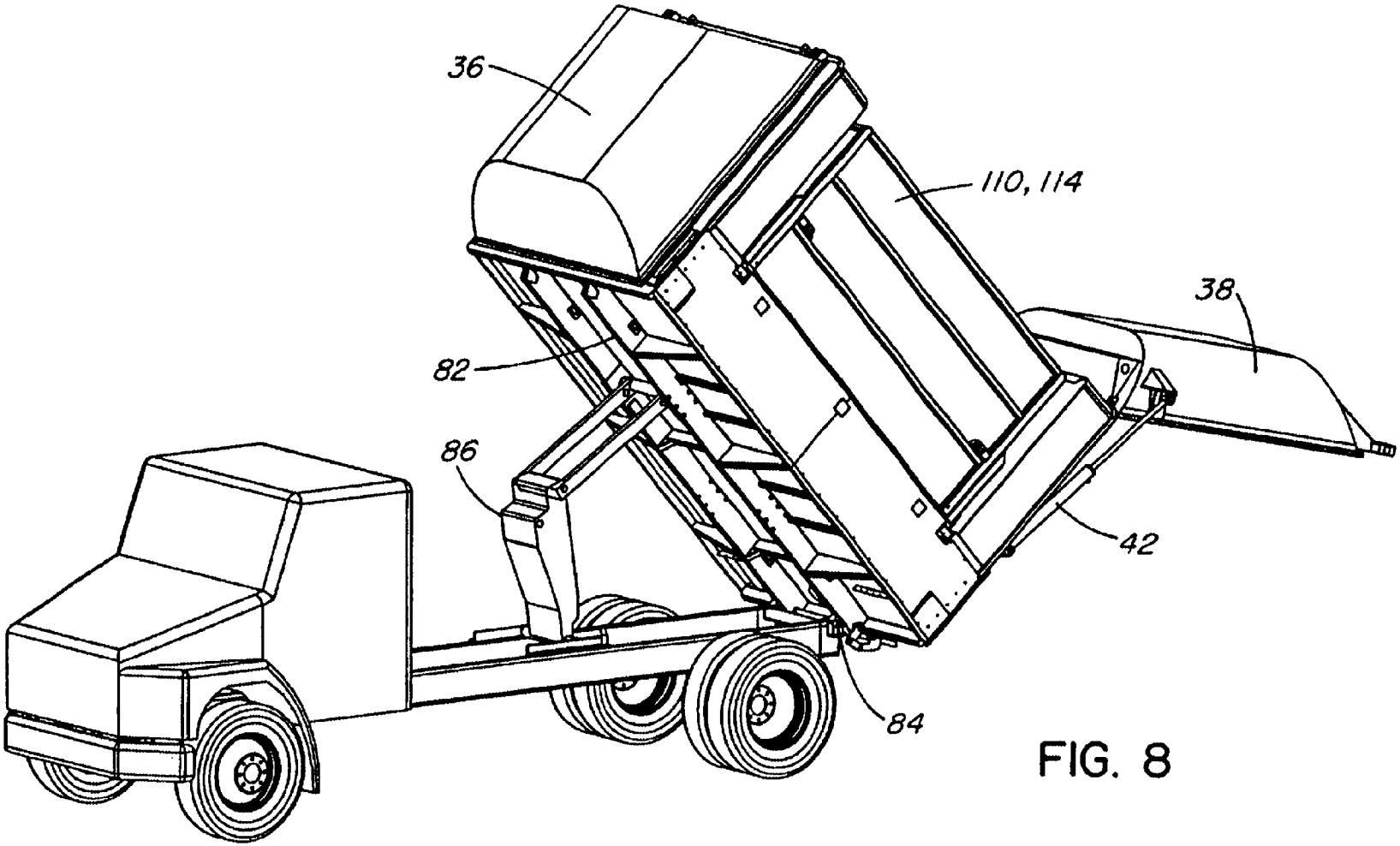
FIG. 8 is a further perspective of the complete compaction and handling apparatus as in FIG. 1 but with the compaction and handling apparatus in the raised dumping position with the tailgate open.

FIG. 8 shows the truck mounted compaction and handling apparatus 20 in the raised dumping position with the tailgate 38 open. It will be seen that the underside of the compaction and handling apparatus 20 is provided with a sturdy frame construction 82 and that the rearward end portion of same is provided with suitable pivot hinges 84 which are pivotably secured to the rear end portion of the truck chassis 22. A conventional dumping actuator 86 is provided to effect dumping of the assembly. The previously noted tailgate actuator cylinder 42 is shown in the extended position with the tailgate in the full open position.

Figure 9:
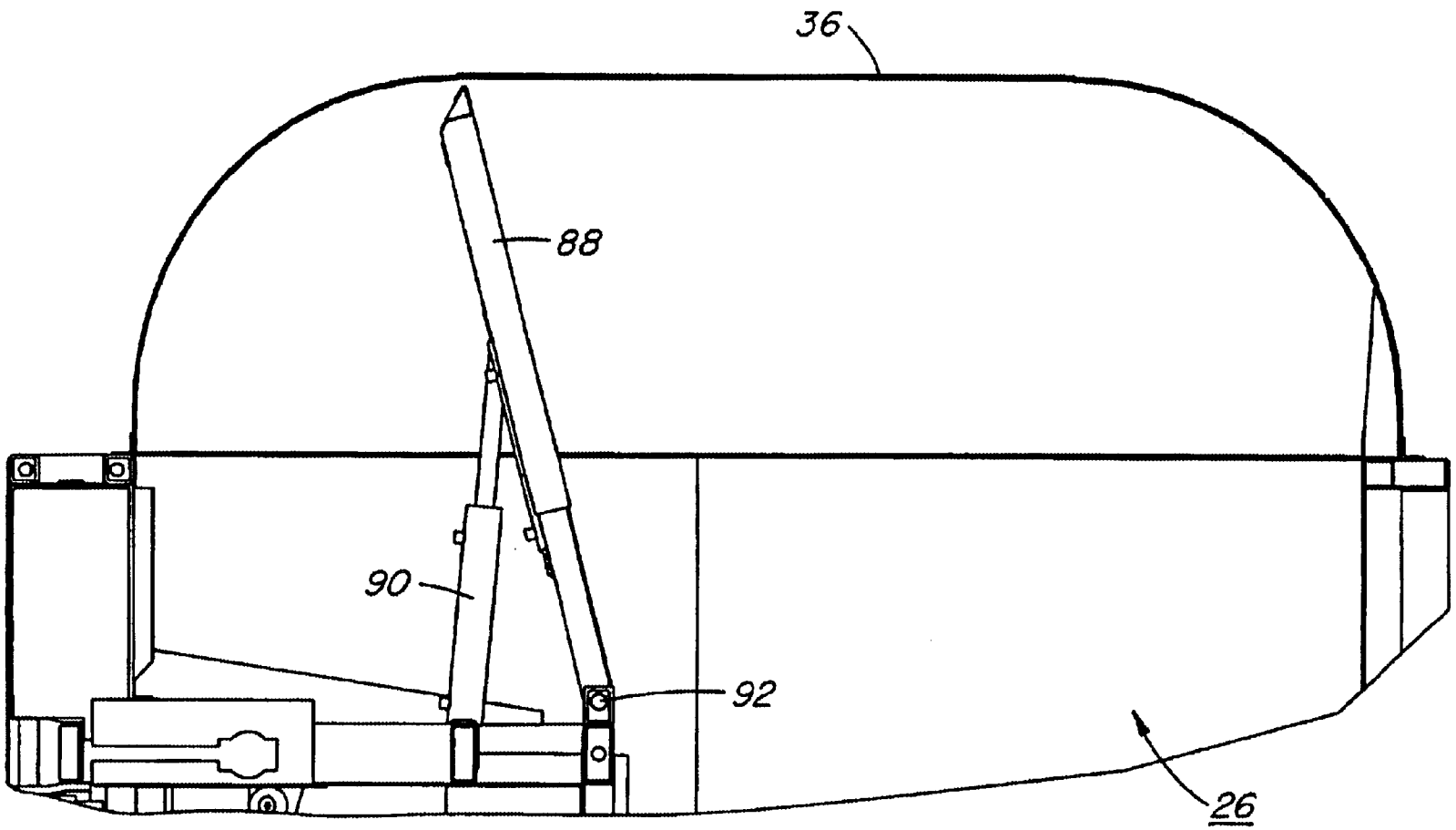
FIG. 9 is a partial horizontal section view taken at the frontal end of the storage container and looking downwardly from above and illustrating the pivotally mounted clean out panel and its actuating cylinder.
Figure 10:
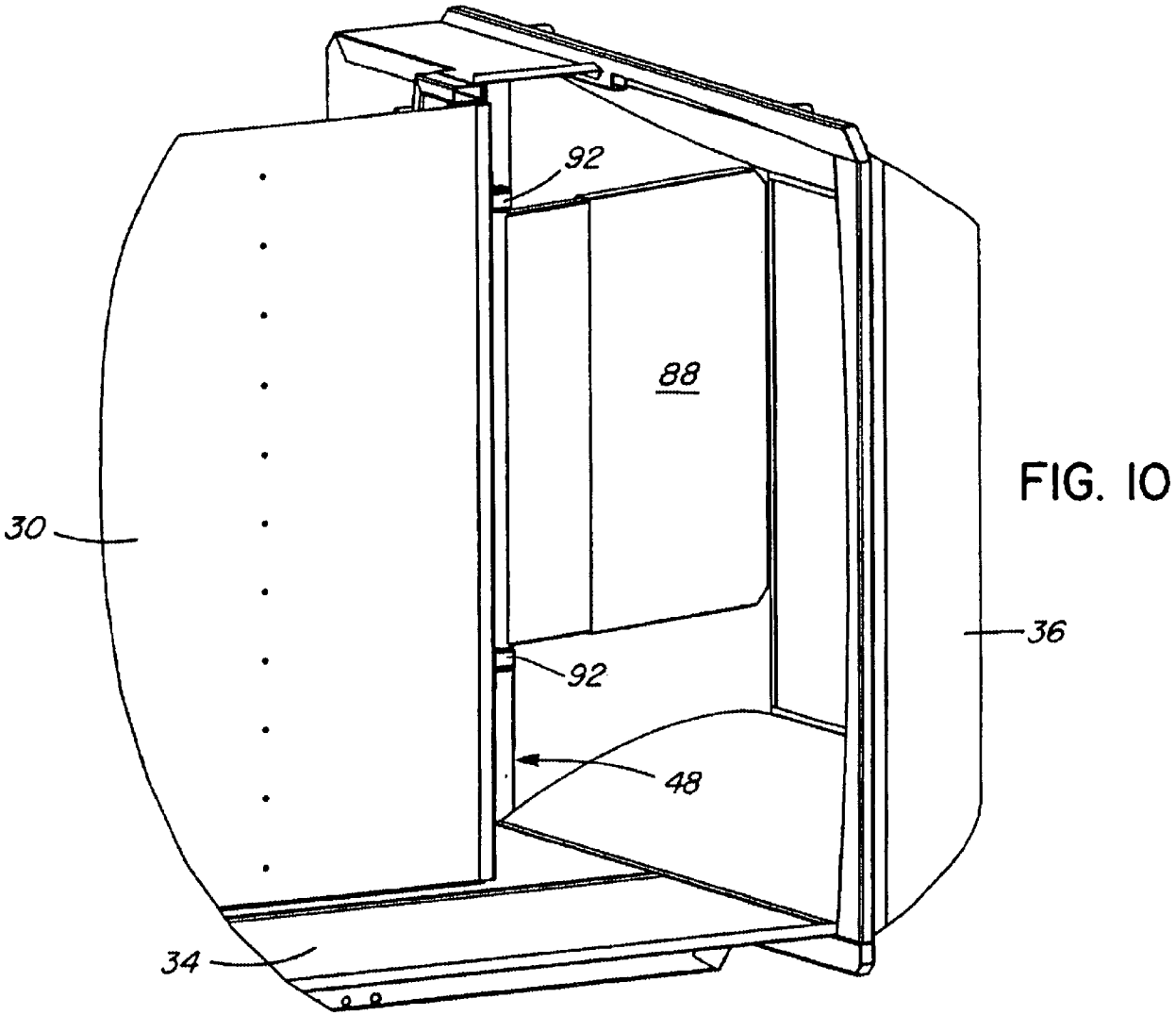
FIG. 10 is a cut-away perspective view of the frontal portion of the storage container and looking generally inwardly and forwardly and illustrating the pivotally mounted clean out panel and associated assemblies.

FIG. 9 is a partial section view taken at the frontal end of the storage container 26 looking downwardly from above and illustrating a pivotally mounted clean-out panel 88 and is actuating cylinder 90. Referring to FIG. 10 which is cutaway perspective view of a frontal portion of the storage container 26 looking generally inwardly and forwardly, it will be seen that the clean-out panel 88 is mounted by way of upper and lower panel hinges 92 so that when the actuating cylinder 90 is operated, the clean-out panel 88 pivots with a sweeping motion thereby to clear out materials which may tend to hang up in the upper corner portion of the curved frontal wall 36 of the storage container. The actuating cylinder 90 is normally retained in the retracted condition during the loading/packing procedures and the clean-out panel 88 is activated in the course of unloading/dumping of the storage container 26 thereby to ensure full clean out is accomplished.

Figure 11:
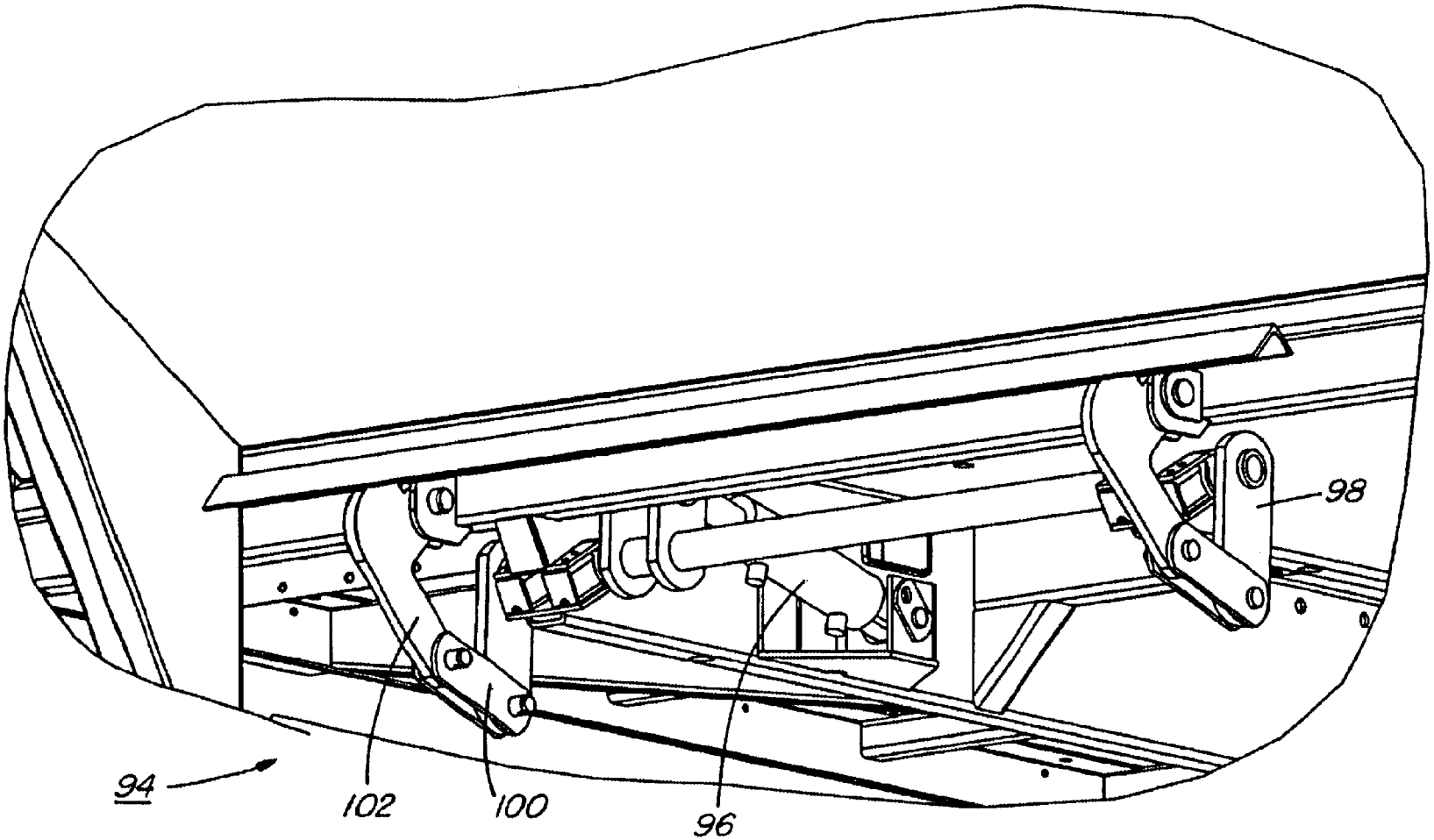
FIG. 11 is a perspective view looking generally upwardly and toward the rear of the apparatus and illustrating the rear tailgate locking assembly.
Figure 12:
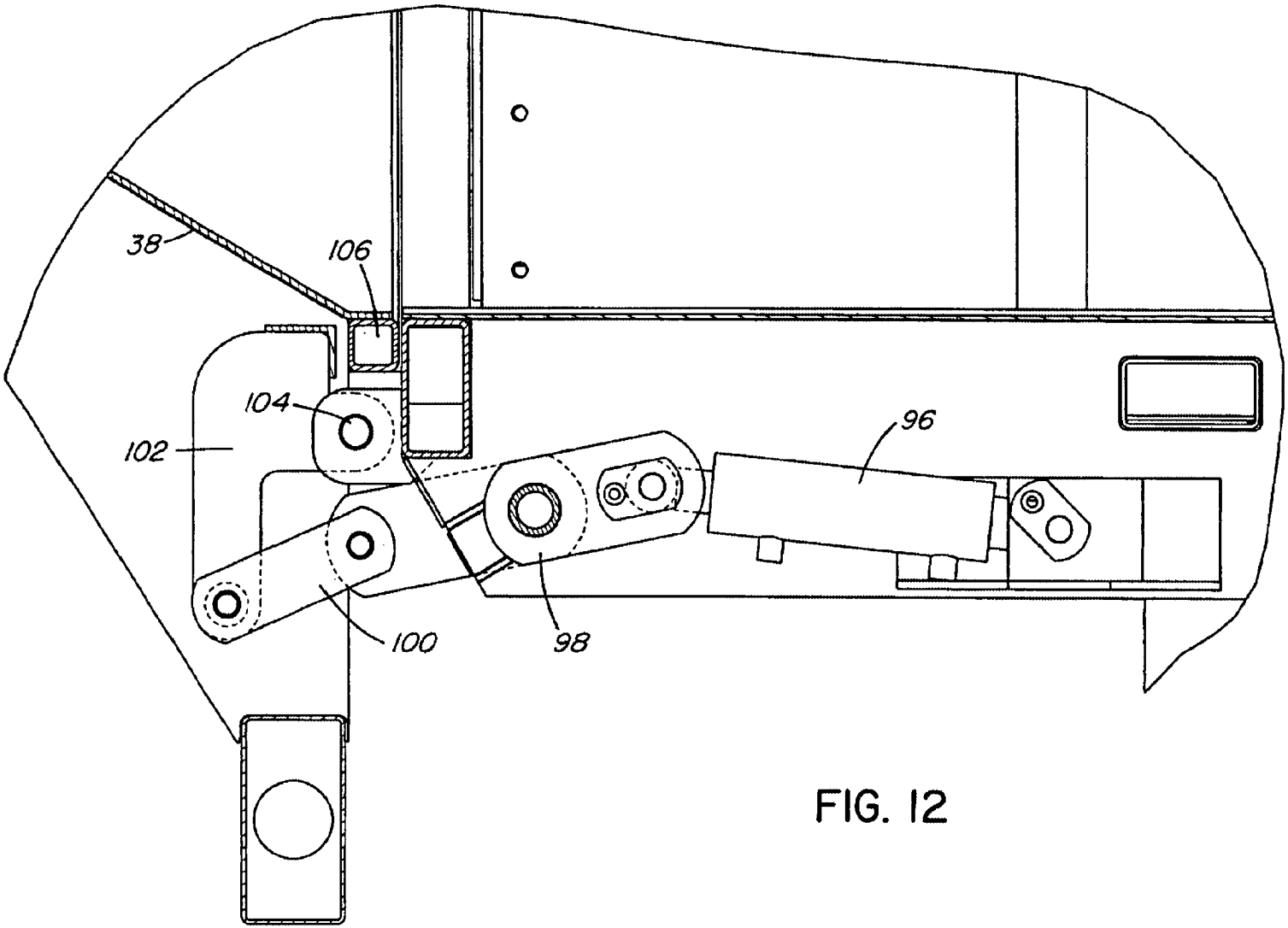
FIG. 12 is a partial longitudinal section view further illustrating the tailgate locking actuator and associated linkages.

Referring to FIGS. 11 and 12, it will be seen that FIG. 11 is a perspective view looking generally upwardly and toward the rear of the storage container 26 and illustrating the rear tailgate locking assembly 94. FIG. 12 further illustrates the tailgate locking actuator and associated linkages. Tailgate locking assemblies are, in general, well known in the art and an important factor is that the locking assembly be sturdily constructed to withstand the substantial compaction forces exerted. With reference to FIG. 12 there is shown a lock actuator cylinder 96 mounted to the storage container underframe which cylinder 96 engages a tailgate lock pivot linkage 98 which, in turn, is connected to a tailgate lock link 100 and this, in turn, is connected to the elongated tailgate lock 102 which is pivotally connected (104) to a rearward portion of the storage container frame. This lock 102 is adapted to engage a lip portion 106 extending along the lower edge of the tailgate 38 to securely hold the tailgate in the closed position. When the lock actuating cylinder 96 is extended however, the above-described linkages rotate the tailgate lock 102 to the open or released position thereby allowing the tailgate to open.

Figure 13:
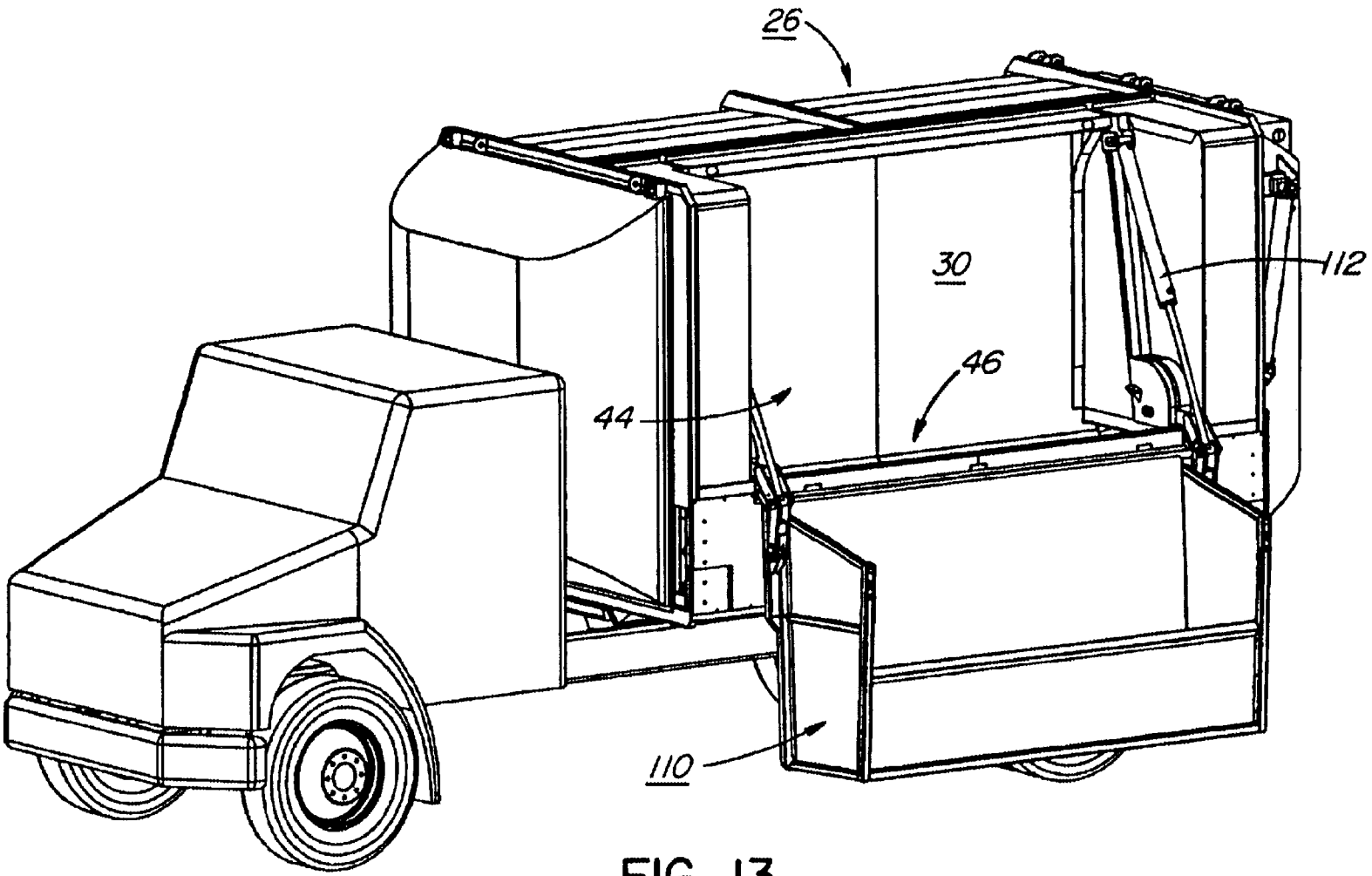
FIG. 13 is a further perspective view similar to FIG. 1 but with a manual loading hopper in the fully opened or down position.

Referring to FIG. 13, there is shown a perspective view of the complete apparatus 20 with a manual loading hopper 110 shown as being mounted adjacent to and alongside the charging hopper 46 for movement about pivot hinges from the lowered position shown to permit filling of the loading hopper 110 to a raised position within recess 44 generally above the charging hopper 52 for dumping of the materials into the charging hopper. This movement of the loading hopper 110 is effected by way of a pair of elongated loading hopper actuating cylinders 112 interconnected between the opposing ends of the loading hopper and upper portions of the storage container generally as shown.

Figure 14:
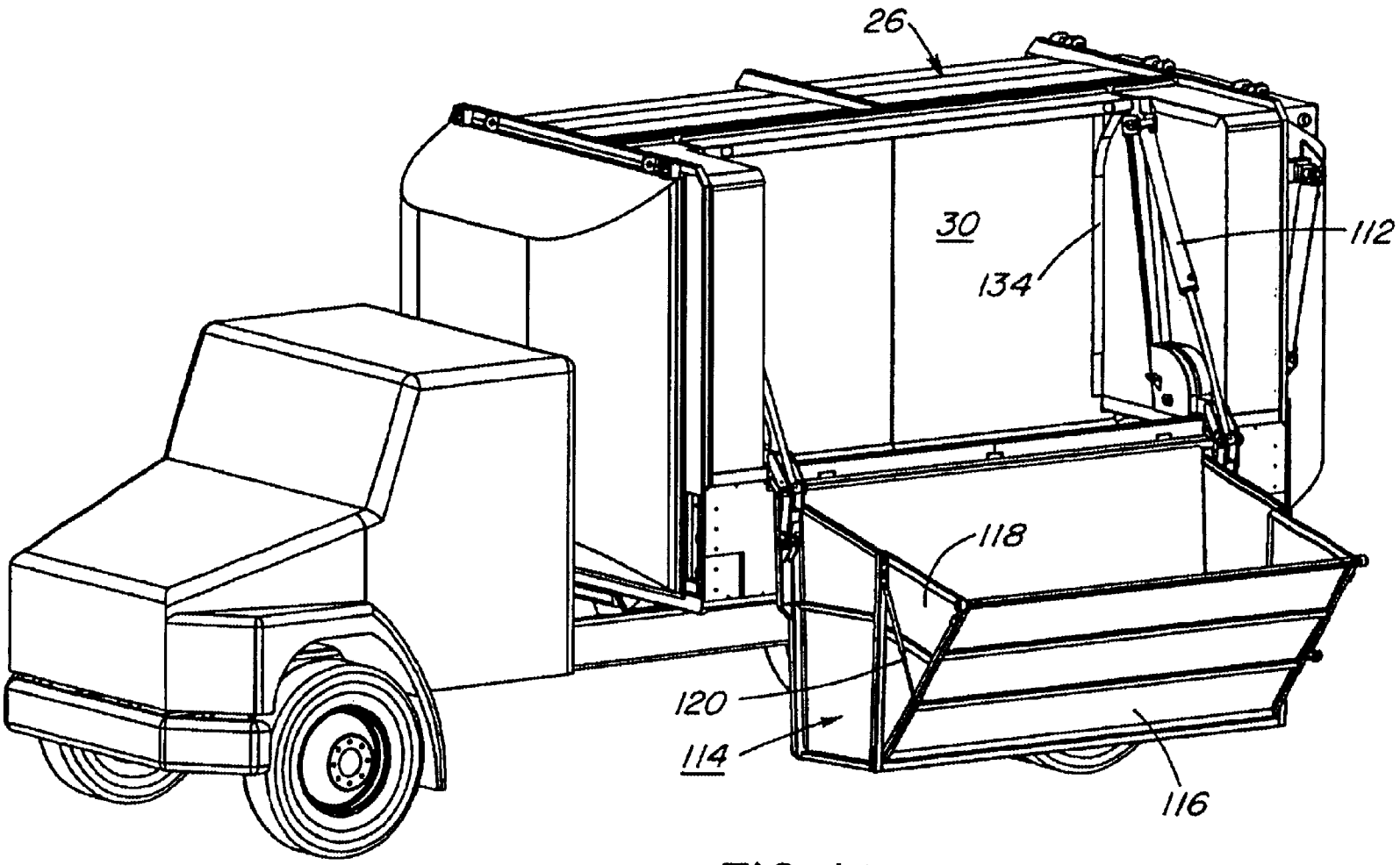
FIG. 14 is a perspective view similar to FIG. 13 but showing a modified extendable loading hopper with an extendable panel arrangement to provide greater capacity.
Figure 15:
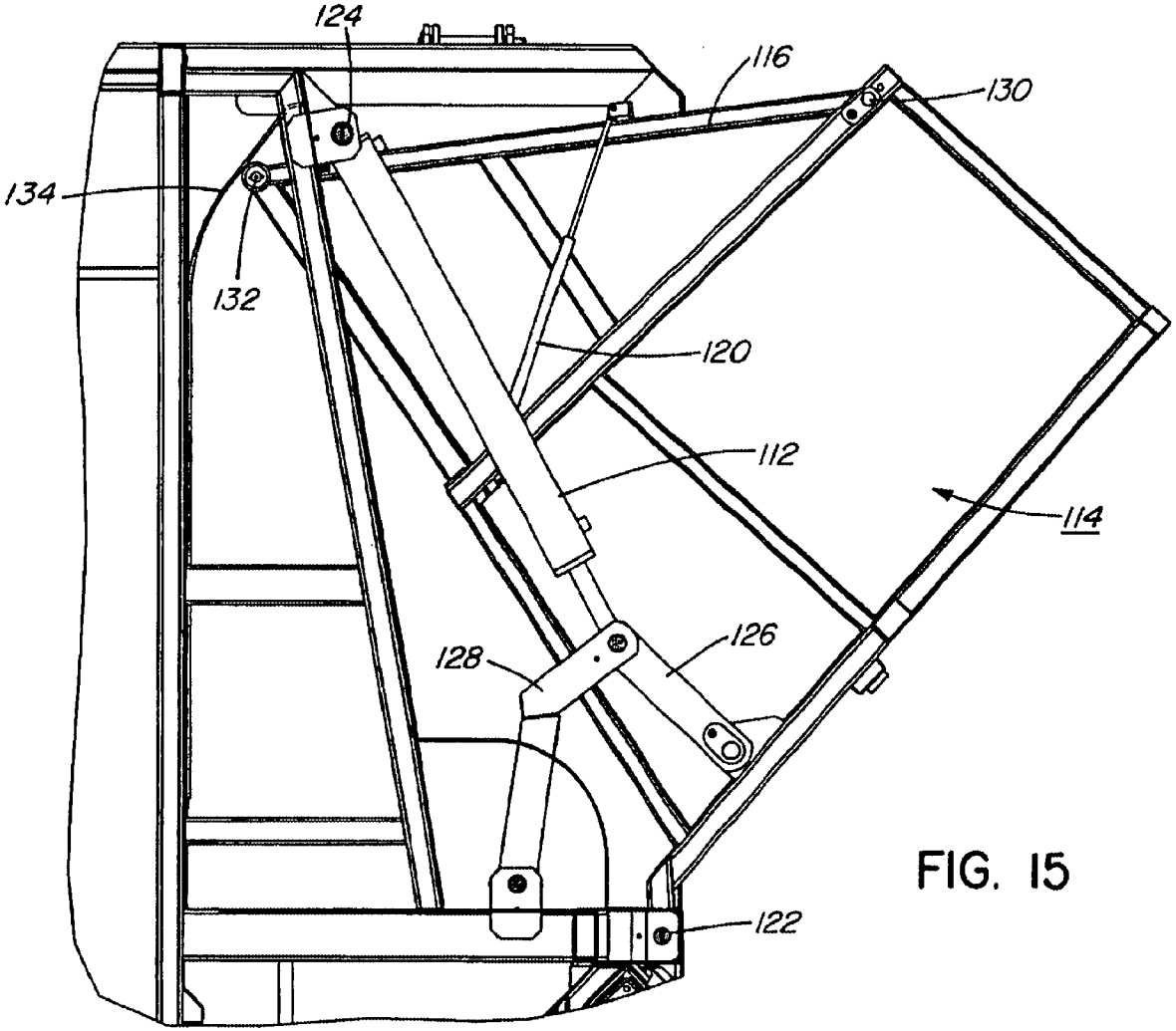
FIG. 15 is a transverse view looking toward one end of the loading hopper illustrated in FIG. 14 with such hopper in the raised dumping position and illustrating various linkages and actuator mechanisms associated with the loading hopper.
Figure 16:
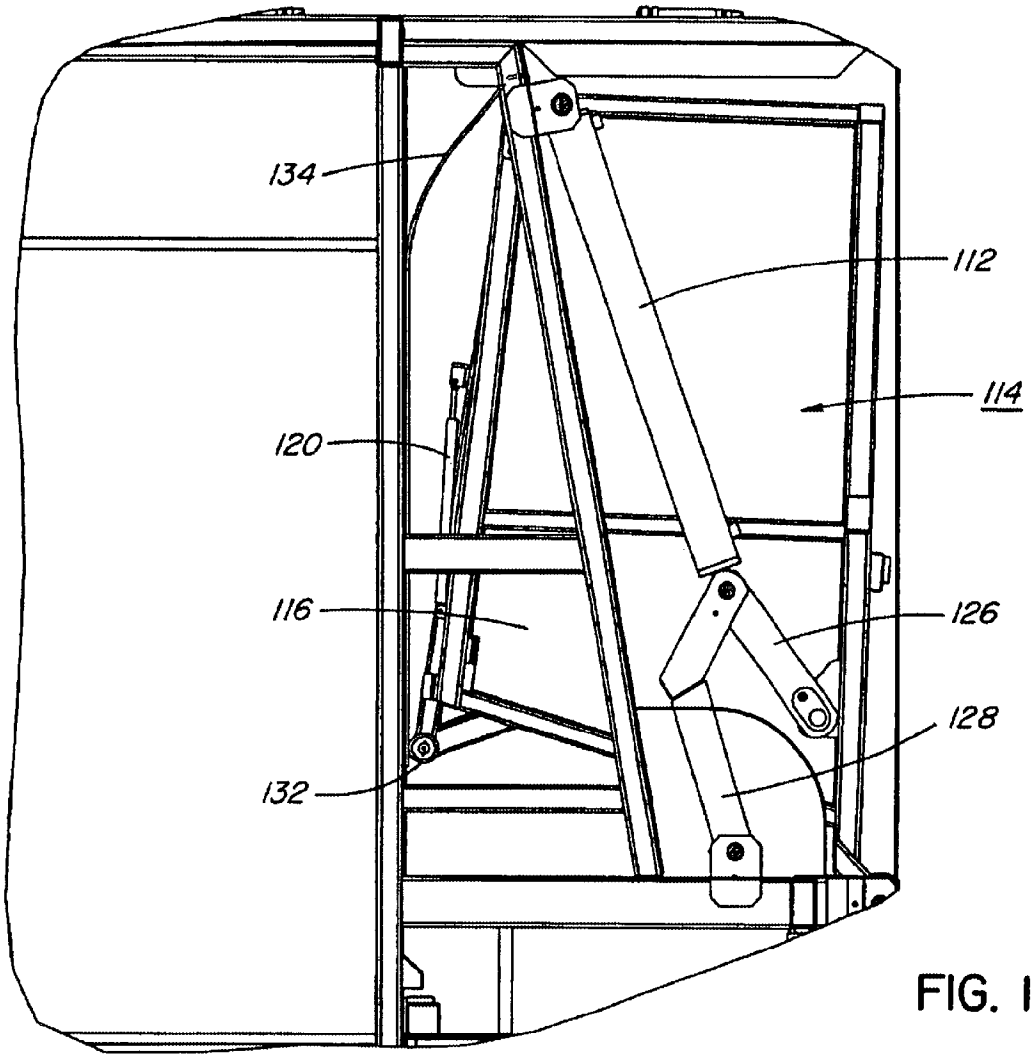
FIG. 16 is a view similar to FIG. 15 and showing the relative positions of the various linkages when the hopper is in the fully raised travel position above the charging hopper.

An extendable loading hopper 114 is illustrated in FIGS. 14–16. Here it will be seen that the extendable loading hopper is provided with a pivotally mounted panel 116 which effectively acts to increase the capacity of the loading hopper. This panel is hinged to the main body of the hopper 114 along its lower edge and it is provided with opposed triangle-shaped end panels which cooperate with the end panels of the loading hopper 114 to prevent spillage of materials. Elongated gas shocks 120 extend between the main body of the loading hopper and the extendable panel as shown.

Referring now to FIGS. 15 and 16, further details of the above-noted assemblies are shown. The extendable loading hopper 114 is hinged adjacent opposing ends of the charging hopper by way of spaced-apart loading hopper hinges 122. The hopper or actuating cylinders 112 each extend between an upper attachment points 124 and a lower loading hopper link 126 as well as well as a doglegged shaped pivot link 128, the lower end of which is affixed to the loading hopper support assembly. The extendable panel is shown connected by the extendable panel hinges 130 to the loading hopper 114 per se. The gas shock 120 is also shown as extending between the extendable panel and the loading hopper per se. The upper distal edge portion of the extendable panel is provided with rollers 132 which engage curved roller guides 134 which extend inwardly and hence downwardly along opposed end portions of the inner divider panel 30 of the storage container (see also FIG. 14).

With the loading hopper 114 in the partially raised position shown in FIG. 15, the rollers 132 on the upper edge of the extendable panel 116 have just begun to contact the roller guides 134. As the loading hopper is made to rotate counterclockwise by way of the hopper lifting cylinders 112, the roller guides 134 interact with the rollers 132 thus causing the extendable panel 116 to be pivoted towards the main body of the loading hopper against the relatively small forces exerted by the gas shocks 120. In fact these gas shocks exert just enough force as to prevent premature closure of the extendable panels 116. Since the materials which were in the loading hopper are relatively quickly released into the charging hopper 46, the closure of the extendable panel is not impeded and rotation of the entire loading hopper continues into the fully upright travel position illustrated in FIG. 16 with the loading hopper 114 positioned within loading hopper recess 44 directly above the charging hopper 46. At this point it will be seen that the extendable panel is fully closed. When the reverse action occurs, i.e., as the loading hopper 114 is pivoted outwardly, the gas shocks 120 act to extend the extendable panel with the rollers 132 travelling along the roller guides and controlling the extend of the panel opening process.

Figure 17:
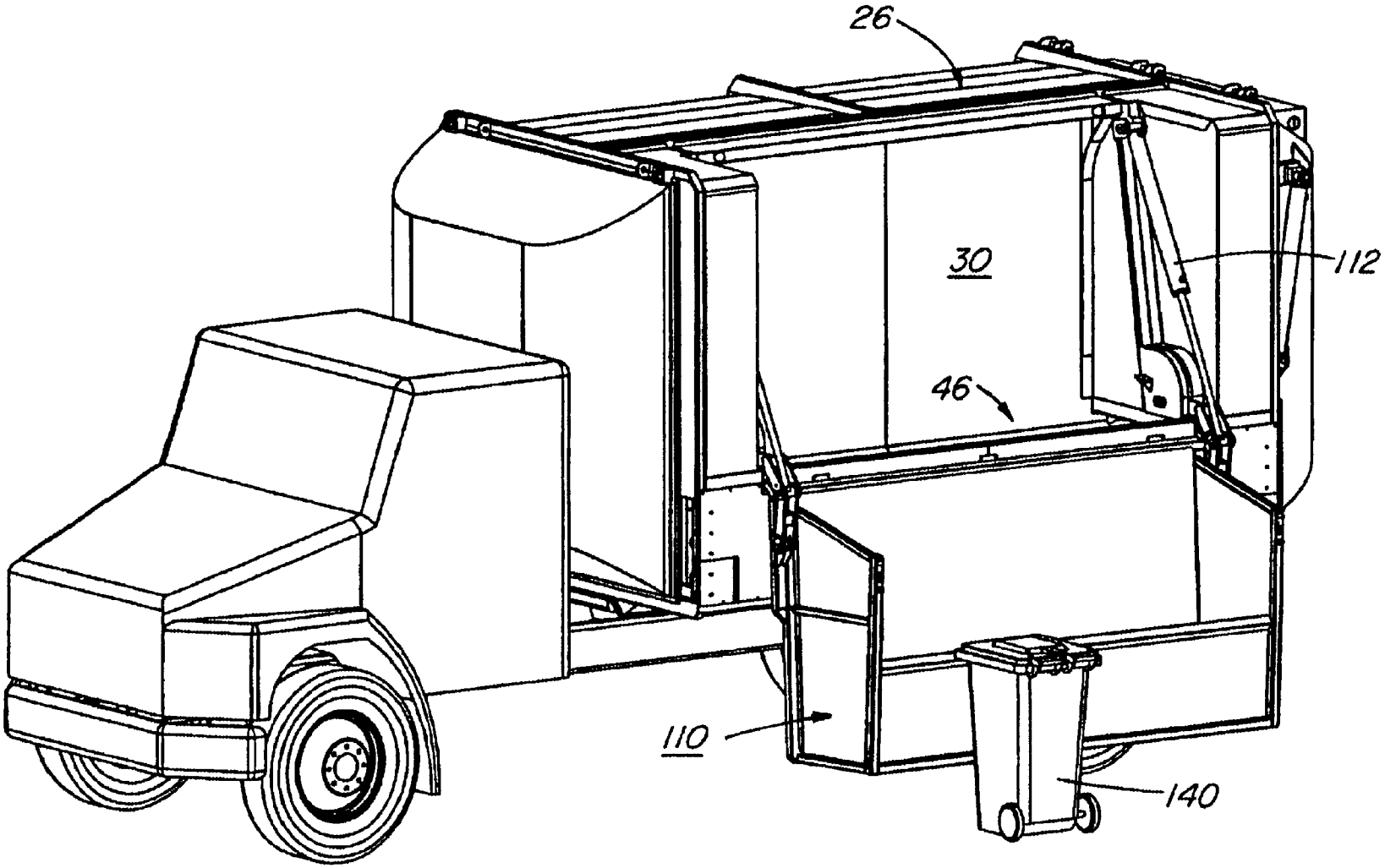
FIG. 17 is a perspective view of the compaction and handling apparatus with a modified form of loading hopper in the open position in engagement with a roll out cart which has been moved into a position ready to be dumped.
Figure 18:
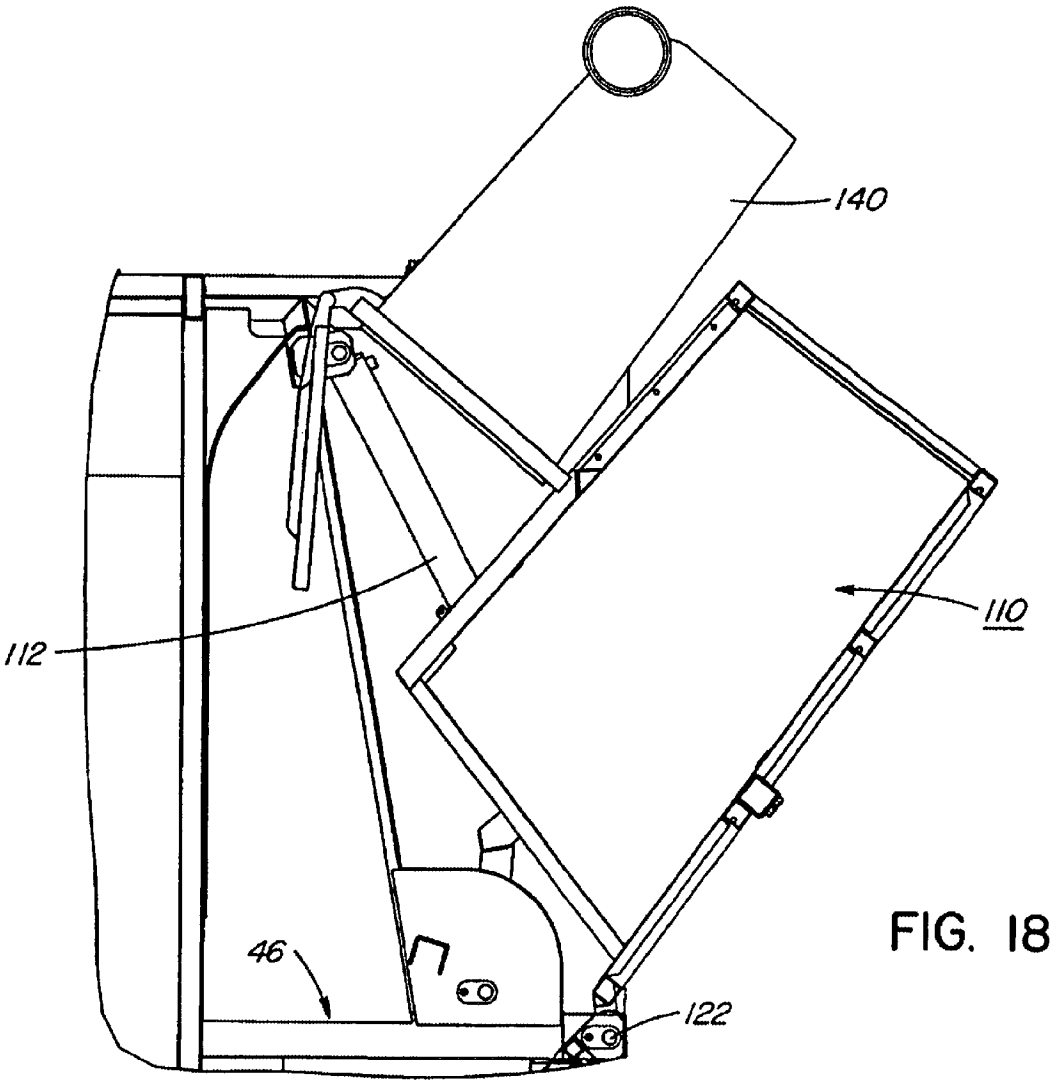
FIG. 18 is a transverse view partly in section showing the loading hopper in elevation along with its associated mechanisms together with the roll out cart which has been raised upwardly in the dumping position along with the loading hopper.

FIGS. 17 and 18 illustrate the simple manual loading hopper 110 depicted in FIG. 13 when used in conjunction with a specially designed rollout cart 140 which is provided with suitable hooks to engage the frontal ledges of the loading hopper 110 so that as the loading hopper is swung to the dumping position shown in FIG. 18, the rollout cart is also swung upwardly along with it such that the contents of the rollout cart are dumped directly into the charging hopper 46. This relatively simple adaptation offers obvious time and labour saving advantages.

Figure 19:
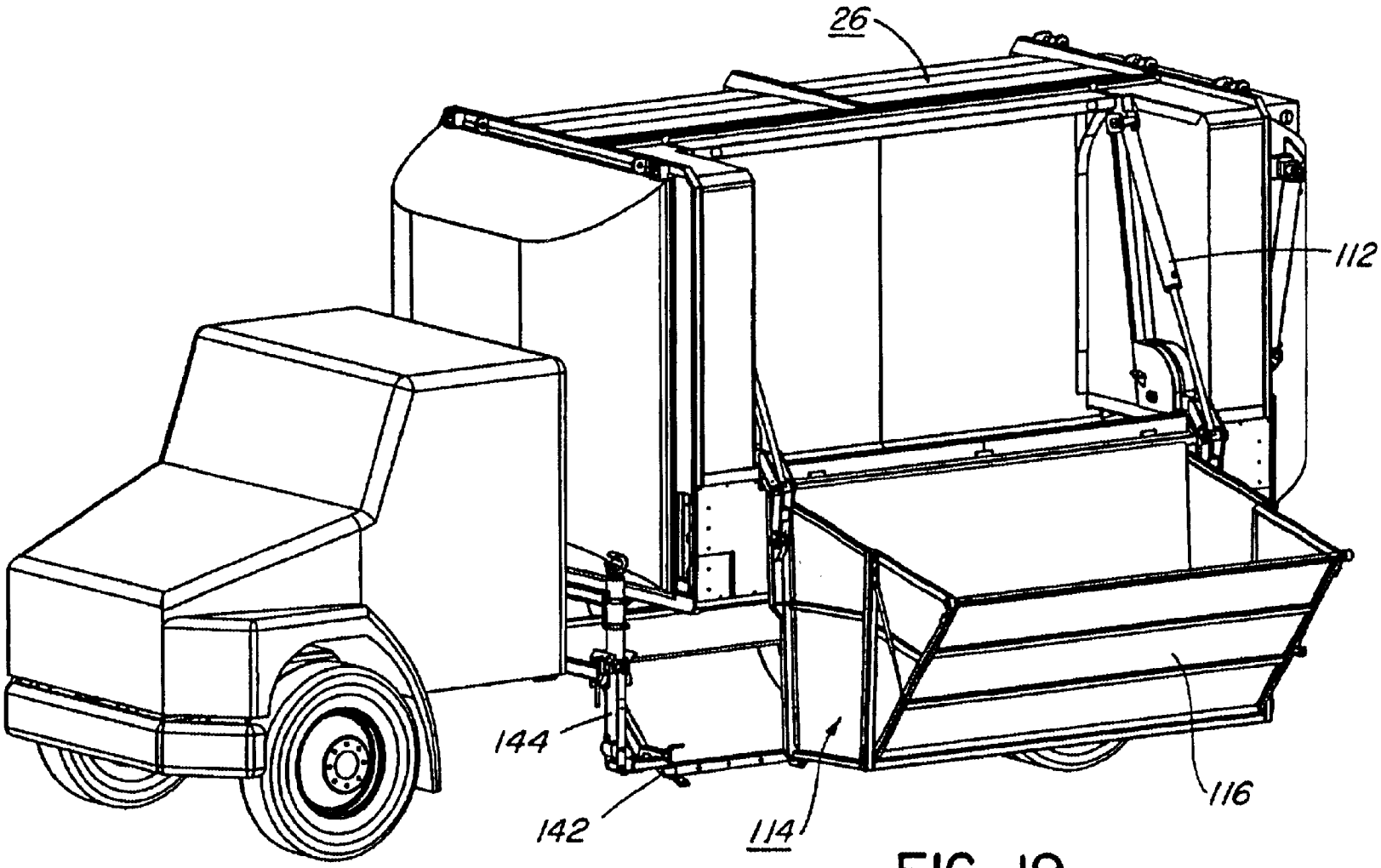
FIG. 19 is a perspective view similar to FIG. 14 showing the compaction and handling apparatus with extendable loading hopper, such apparatus being equipped with an extendable arm assembly having an actuator thereon for tipping a container assembly.

FIG. 19 is a further perspective view showing the compaction and handling apparatus with the extendable loading hopper 114 as described previously and wherein the vehicle is equipped with an extendable arm 142 having a hydraulic actuator cylinder 144 thereon arranged for tipping a ground mounted container assembly. A vehicle mounted extendable arm assembly having an actuator thereon adapted for tipping a container assembly of this nature is described in my U.S. Pat. No. 6,077,020 issued Jun. 20, 2000, the disclosure of which is incorporated herein by reference.

Figure 20:
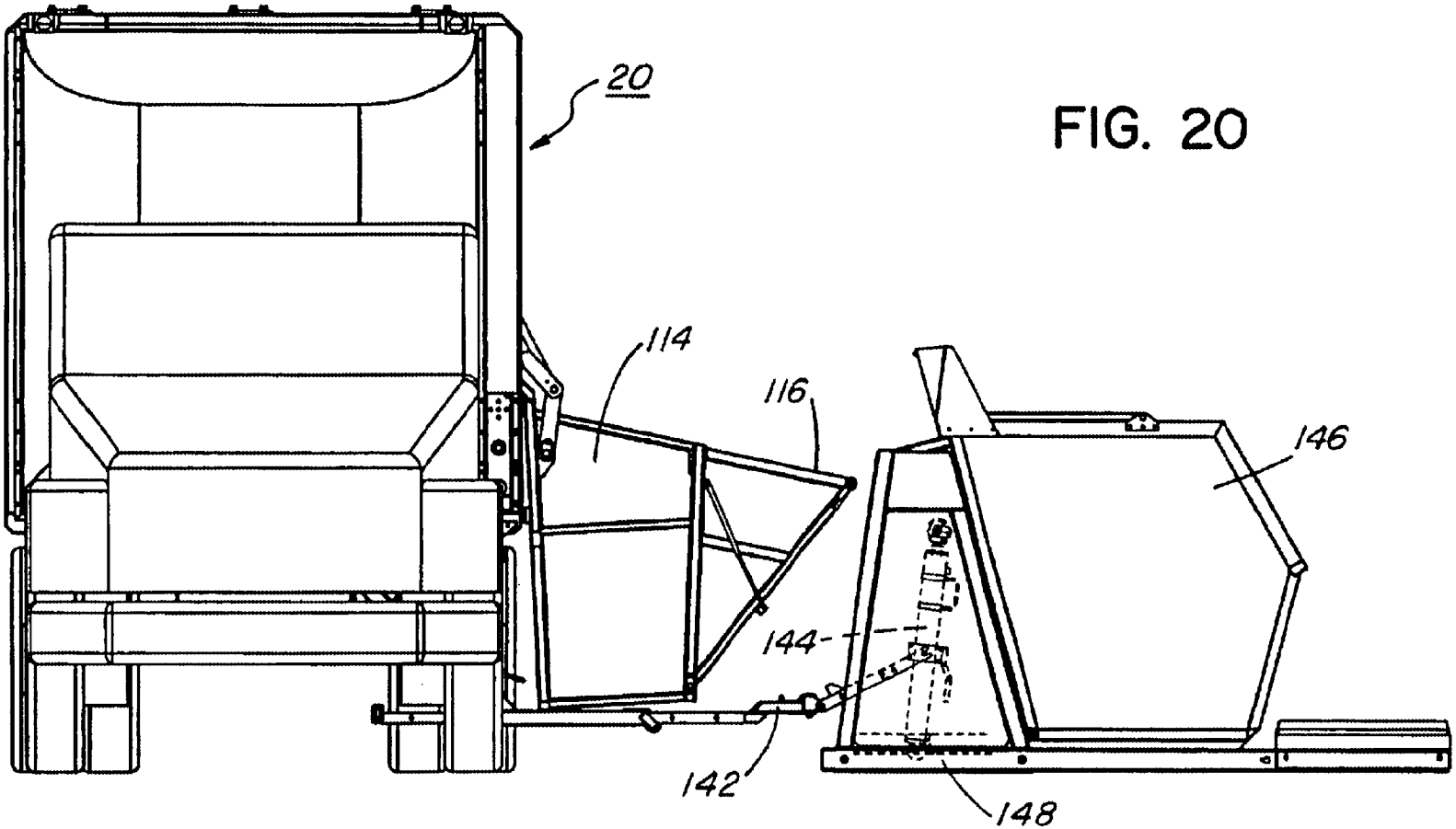
FIG. 20 is a front elevation view of the compaction and handling apparatus with the extendable loading hopper in the loading position with the extendable arm and actuator located in a position to engage a tiltable hopper assembly.

With particular reference to FIG. 20 there is shown a front elevation view of the compaction and handling apparatus 20 with the extendable loading hopper 114 in the downwardly located loading position. The extendable arm 142 is in its outwardly extended position and the hydraulic actuator 144 has been located in the required position so as to engage between a tiltable container 146 and the frame 148 upon which it is mounted.

Figure 21:
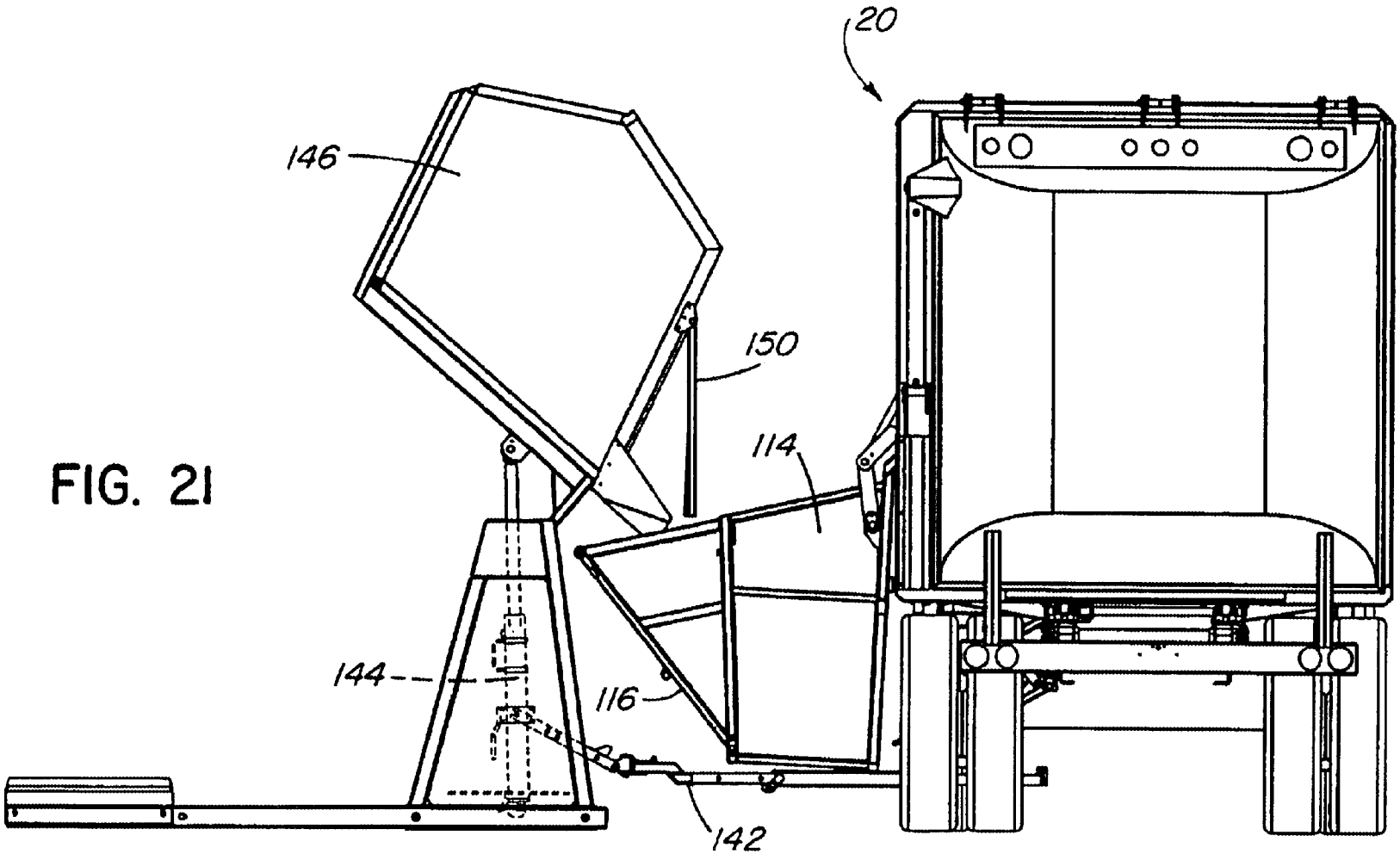
FIG. 21 is a view similar to FIG. 20 but taken from the rear and showing the hydraulic actuator extended such that the container has been raised into the tipping position whereby materials therein are dumped into the extendable loading hopper.

FIG. 21 is a view similar to FIG. 20 but taken from the rear. This figure shows the hydraulic actuator 144 in its extended condition such that the container 146 has been raised and tilted around into the tipping position such that its lid 150 has automatically opened thereby to discharge the materials therein into the extendable loading hopper 114 described previously. Following discharge of the materials, the hydraulic actuator 144 is retracted such that as the container 146 rotates back into the loading position as shown in FIG. 20, the extendable arm 142 is retracted along with the hydraulic actuator cylinder and stowed alongside the chassis of the vehicle, and thereafter, the loading hopper lift cylinders 112 are actuated thereby to swing the extendable loading hopper 114 around such that its load is discharged into the charging hopper 46 in the manner described above. When the loading hopper has reached the travel position above the charging hopper, the vehicle moves away to a further collection site.

As will be apparent from the description set out above, once the materials have been received into the charging hopper 46, the packing cylinders 56, 58 are activated to cycle the packing head 52 along the charging hopper thereby to force the materials through the forward or rear opening 48, 50 described previously and into the storage container 26. For example, when the forward packing cylinder 56 is fully extended and the packing head 52 is at the rear of the charging hopper 46, the hydraulics are reversed, by an well-known means, and the rear packing cylinder 58 is activated to move the packing head 52 toward the front of the charging hopper 46. This back-and-forth motion empties the charging hopper 46 and compacts the material into the storage container 26 through the passageways defined by the openings 48, 50 referred to previously. Once the material passes through these openings, the material is guided by the convexly-curved front end section and the convexly-curved rear tailgate 38 in such a way as to assist in completely filling the storage container 26.

When the storage container 26 is to be emptied, the rear tailgate is unlocked by the mechanisms described above and rotated around the upper hinges from a position approximately perpendicular to the storage container floor to a position approximately parallel to that floor. Dumping actuator 86 then rotates the entire compaction and handling apparatus approximately 45° to empty the contents thereof through the opening created by the open tailgate. Removal of the material from the front of the storage container 26 will of course be assisted by the previously described clean-out panel 88 which is rotated by its associated actuator to assist in sweeping away any materials which might tend to lodge adjacent the front of the container.

The addition of the manual loading hopper 112 to the apparatus allows for material to be collected at a lower loading height. As described above, such hopper is emptied by rotation of same about the loading hopper hinges from the lower receiving position to the upper dumping position. This is accomplished through the use of the actuators 112 acting via the loading hopper linkage arrangement and pivot linkage described above.

The extendable loading hopper 114 described previously rotates in the same manner as the manual loading hopper but has the additional feature of the extendable panel 116. The extendable panel rotates outwardly from the this hopper when large quantities of material are received. As this hopper is rotated from the lower receiving position to the raised dumping position, the rollers described previously come into contact with the roller guides 134 which provides an ever decreasing arc to gradually collapse the gas shock 120 and thus rotate the extendable panel into the hopper body as the material is emptied. When this rotation is completed the extendable hopper is approximately directly over the packing head 52 and the charging hopper 46 and in the travel position within the loading hopper recess 44.

Preferred embodiments of the invention have been described by way of example. Those skilled in the art will realize that various modifications and changes may be made while remaining within the spirit and scope of the invention. Hence the invention is not to be limited to the embodiments as described but, rather, the invention encompasses the full range of equivalencies as defined by the appended claims.

What is claimed is:

1. A waste and recyclable materials compaction and handling apparatus including:

a storage container for the materials;

an elongated charging hopper defined and connected adjacent to and alongside said storage container for receiving the materials, said charging hopper including openings defining pathways leading into the interior of said storage container;

a packing head mounted for travel in both rearward and forward directions within and along said charging hopper between end portions thereof;

at least one driver connected to said packing head to effect the travel thereof in said directions along and within said charging hopper between positions adjacent said hopper end portions; and said packing head having opposed packing faces adapted to engage the materials placed in said charging hopper such that as said packing head is made to travel along and within said charging hopper by said at least one driver, said materials are compacted within and positively forced from the charging hopper through said pathways and thence into the interior of the storage container.

2. The apparatus of claim 1 wherein said packing head is mounted for travel along an elongated support assembly extending lengthwise of said charging hopper.

3. The apparatus of claim 2 wherein said at least one driver comprises at least one hydraulic packing cylinder extending lengthwise of said charging hopper.

4. The apparatus of claim 3 wherein said support assembly and said at least one hydraulic cylinder extend along a side portion of said charging hopper, said charging hopper being located along a lower portion of said storage container.

5. The apparatus of claim 4 wherein a pair of said hydraulic packing cylinders is provided, each being adapted for moving the packing head in a respective one of rearward and forward directions of travel.

6. The apparatus of claim 1 wherein said storage container includes wall portions contoured to assist in movement of the materials being compressed by said packing head through said pathways and into and within the interior of the storage container.

7. The apparatus of claim 6 wherein said wall portions comprise a frontal contoured end section and a rear contoured end section of said storage container both shaped to facilitate said movement of the materials into and within said storage container.

8. The apparatus of claim 7 wherein said rear end section is hinged to provide a tailgate which can be opened to permit the contents of the storage container to be dumped.

9. The apparatus of claim 8 including pivotal connections for securing the compaction and handling apparatus to the chassis of a transport vehicle, and mechanisms for opening and closing said tailgate in the course of a dumping procedure.

10. The apparatus of claim 8 including a clean out panel mounted for pivotal movement within the storage container adjacent said frontal end section, and an actuator for pivoting said clean out panel to dislodge materials adjacent said frontal end section.

11. The apparatus of claim 1 including a loading hopper mounted adjacent to and alongside said charging hopper for movement from a first lowered position to permit ready filing of the loading hopper to a second raised position above the charging hopper for dumping of materials into the charging hopper.

12. The apparatus of claim 11 wherein said loading hopper has a retractable side wall which moves to enlarge the capacity of the loading hopper during filling and which partly closes during movement to the second raised position.

13. The apparatus of claim 11 wherein said packing head is mounted for travel along an elongated support assembly extending lengthwise of said charging hopper.

14. The apparatus of claim 13 wherein said at least one driver comprises at least one hydraulic packing cylinder extending lengthwise of said charging hopper.

15. The apparatus of claim 14 wherein said support assembly and said at least one hydraulic cylinder extend along a side portion of said charging hopper, said charging hopper being located along a lower portion of said storage container.

16. The apparatus of claim 15 wherein a pair of said hydraulic packing cylinders is provided, each being adapted for moving the packing head in a respective one of rearward and forward directions of travel.

17. A waste and recyclable materials compaction and handling apparatus including:

a storage container for said materials;

an elongated charging hopper defined and connected adjacent to and extending alongside a lower portion of said storage container for receiving the materials, said charging hopper including openings defining pathways leading into the interior of said storage container;

a packing head mounted for travel in both rearward and forward directions within and along said charging hopper between end portions thereof;

at least one driver connected to said packing head to effect the travel thereof in said directions along and within said charging hopper between said end portions;

said packing head having opposed packing faces adapted to engage the materials placed in said charging hopper such that as said packing head is made to travel along said charging hopper by said at least one driver, said materials are compacted within and positively forced from the charging hopper through said pathways and thence into the interior of the storage container.

18. The apparatus of claim 17 wherein said packing head is mounted for travel along an elongated support assembly extending lengthwise of said charging hopper.

19. The apparatus of claim 18 wherein said at least one driver comprises at least one hydraulic packing cylinder extending lengthwise of said charging hopper.

20. The apparatus of claim 19 wherein said support assembly and said at least one hydraulic cylinder extend along a side portion of said charging hopper.

21. The apparatus of claim 20 wherein a pair of said hydraulic packing cylinders is provided, each being adapted for moving the packing head in a respective one of rearward and forward directions of travel.

22. The apparatus of claim 17 further including a loading hopper mounted adjacent to and alongside said charging hopper for movement from a first lowered position to permit ready filling of the loading hopper to a second raised position above the charging hopper for dumping of materials into the charging hopper.

23. The apparatus of claim 22 wherein said loading hopper has a retractable side wall which moves to enlarge the capacity of the loading hopper during filling and which partly closes during movement to the second raised position.

* * * * *

UNITED STATES PATENT AND TRADEMARK OFFICE

CERTIFICATE OF CORRECTION

PATENT NO. : 6,821,077 B2
DATED : November 23, 2004
INVENTOR(S) : Neufeldt

It is certified that error appears in the above-identified patent and that said Letters Patent is hereby corrected as shown below:

Column 2,
Line 64, “one” should read -- on --

Column 3,
Line 33, “receiver” should read -- receiving --
Line 39, “picking” should read -- packing --

Column 5,
Line 13, “container.” should read -- container; --

Column 6,
Line 26, “real” should read -- rear --

Column 9,
Line 23, “extend” should read -- extent --

Signed and Sealed this

Twenty-fourth Day of May, 2005

JON W. DUDAS
*Director of the United States Patent and Trademark Office*